US012245656B2

(12) United States Patent
Kosenick

(10) Patent No.: US 12,245,656 B2
(45) Date of Patent: Mar. 11, 2025

(54) SOLE STRUCTURE FOR ARTICLE OF FOOTWEAR

(71) Applicant: NIKE, Inc., Beaverton, OR (US)

(72) Inventor: Jonathan Kosenick, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 80 days.

(21) Appl. No.: 18/173,552

(22) Filed: Feb. 23, 2023

(65) Prior Publication Data

US 2023/0270205 A1 Aug. 31, 2023

Related U.S. Application Data

(60) Provisional application No. 63/314,345, filed on Feb. 25, 2022.

(51) Int. Cl.
*A43B 13/12* (2006.01)
*A43B 13/18* (2006.01)

(52) U.S. Cl.
CPC ..... *A43B 13/127* (2013.01); *A43B 13/122* (2013.01); *A43B 13/188* (2013.01)

(58) Field of Classification Search
CPC ..... A43B 13/127; A43B 13/122; A43B 13/12; A43B 13/188; A43B 13/125; A43B 13/189; A43B 21/28
USPC ..... 36/29, 35 B
See application file for complete search history.

(56) References Cited

U.S. PATENT DOCUMENTS 6,038,790 A * 3/2000 Pyle ..... A43B 7/144 36/28
2004/0154189 A1* 8/2004 Wang ..... A43B 13/12 36/28
2005/0283999 A1* 12/2005 Whatley ..... A43B 13/127 36/29
2010/0251565 A1* 10/2010 Litchfield ..... A43B 13/145 36/35 B
2010/0251567 A1* 10/2010 McInnis ..... A43B 7/24 36/35 B
2012/0233879 A1* 9/2012 Dojan ..... B29D 35/128 428/156
2013/0031804 A1 2/2013 Abshire
2014/0075778 A1* 3/2014 Bruce ..... A43B 13/10 36/29
2014/0075779 A1* 3/2014 Bruce ..... A43B 7/148 36/29
2014/0230272 A1* 8/2014 Feshbach ..... A43B 13/20 36/28

(Continued)

OTHER PUBLICATIONS

European Patent Office (ISA), International Search Report and Written Opinion for PCT App. No. PCT/US2023/063193, mailed May 17, 2023.

*Primary Examiner* — Marie D Bays

(74) *Attorney, Agent, or Firm* — Honigman LLP; Matthew H. Szalach; Jonathan P. O'Brien

(57) ABSTRACT

A sole structure for an article of footwear is provided. The sole structure includes a midsole, a cushion disposed in the midsole and including an inner portion, and an outsole including a first surface defining a ground-contacting surface and an upper surface disposed on an opposite side of the outsole than the ground-contacting surface and opposing the cushion, the outsole including a protrusion that extends in a direction away from the midsole to a greater extent than any other portion of the outsole and being aligned with the inner portion.

17 Claims, 14 Drawing Sheets

(56) References Cited

U.S. PATENT DOCUMENTS

| | | | | |
|---|---|---|---|---|
| 2017/0265566 | A1* | 9/2017 | Case | A43B 13/186 |
| 2018/0098601 | A1* | 4/2018 | Hartenstein | A43B 7/149 |
| 2018/0184750 | A1* | 7/2018 | Winger | A43B 17/035 |
| 2018/0338575 | A1* | 11/2018 | Elder | B32B 7/022 |
| 2020/0205514 | A1 | 7/2020 | VanDomelen | |
| 2020/0305551 | A1 | 10/2020 | Campos, II et al. | |
| 2021/0145119 | A1* | 5/2021 | Campos, II | A43B 23/0285 |
| 2021/0368922 | A1* | 12/2021 | Ho | A43B 21/32 |
| 2022/0022597 | A1 | 1/2022 | Bowman et al. | |
| 2022/0378148 | A1* | 12/2022 | Eldem | A43B 13/40 |
| 2022/0378149 | A1* | 12/2022 | Eldem | A43B 13/20 |
| 2022/0378150 | A1* | 12/2022 | Brooks | A43B 13/206 |
| 2023/0189925 | A1* | 6/2023 | Andreasen | A43B 7/1425 36/29 |

* cited by examiner

SOLE STRUCTURE FOR ARTICLE OF FOOTWEAR

CROSS REFERENCE TO RELATED APPLICATION

This application claims priority under 35 U.S.C. § 119(e) to U.S. Provisional Application No. 63/314,345, filed on Feb. 25, 2022. The disclosure of this prior application is considered part of the disclosure of this application and is hereby incorporated by reference in its entirety.

FIELD

The present disclosure relates generally to an article of footwear and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled chamber to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled chambers typically include a bladder formed from two barrier layers of polymer material that are sealed or bonded together. The fluid-filled chambers may contain air, and are designed with an emphasis on balancing support for the foot and cushioning characteristics that relate to responsiveness as the fluid-filled chamber resiliently compresses under an applied load.

BRIEF DESCRIPTION OF DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
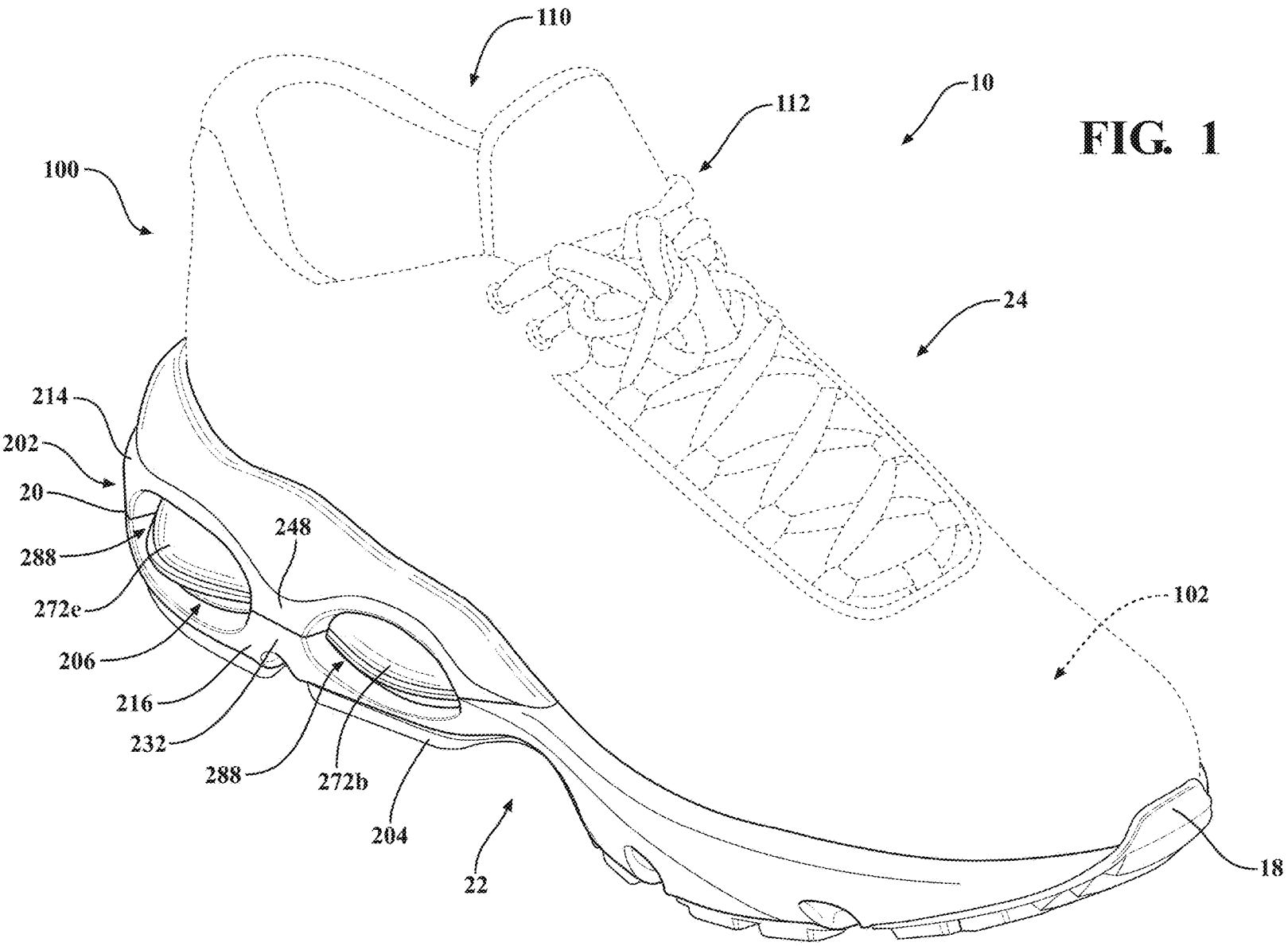
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect, a sole structure for an article of footwear includes a midsole, a cushion disposed in the midsole and including an inner portion, and an outsole including a first surface defining a ground-contacting surface and an upper surface disposed on an opposite side of the outsole than the ground-contacting surface and opposing the cushion, the outsole including a protrusion that extends in a direction away from the midsole to a greater extent than any other portion of the outsole and being aligned with the inner portion.

The sole structure may include one or more of the following optional features. For example, the outsole may include a peripheral band, a forefoot member, and a heel member spaced apart and separated from one another. The heel member may include the protrusion. In one configuration, the cushion may include an outer portion extending around an outer perimeter of the inner portion. In this configuration, the outer portion may include a plurality of lobes. The lobes may be exposed through a plurality of side openings of the midsole.

Further, the inner portion may be a fluid-filled chamber and the outer portion may be a fluid-filled chamber. In this configuration, the inner portion may have a first pressure and the outer portion may have a second pressure, the first pressure being lower than the second pressure.

In one configuration, the midsole may include a midsole upper portion and a midsole lower portion, the midsole lower portion disposed between the cushion and the upper surface of the outsole and the midsole upper portion disposed on an opposite side of the cushion than the midsole lower portion. The midsole upper portion may be made of a first material and the midsole lower portion may be made of a second material, the first material being softer than the second material. Additionally or alternatively, the midsole upper portion and the midsole lower portion may cooperate to define a pocket that receives the cushion. The pocket may include a first portion conforming to at least a portion of the inner portion, a second portion conforming to at least a portion of the outer portion, and a third portion disposed between the first portion and the second portion and being spaced apart from the cushion to define a gap between the cushion and at least one of the midsole upper portion and the midsole lower portion. The pocket may be disposed in a heel region of the sole structure.

The midsole upper portion and the midsole lower portion may be in contact with one another in at least one of a midfoot region of the sole structure and a forefoot region of the sole structure. In this configuration, the midsole lower portion may extend from the upper surface of the outsole to a top surface of the midsole upper portion in the forefoot region of the sole structure. Further, the midsole lower portion may be substantially flush with the top surface of the midsole upper portion in the forefoot region. Additionally or alternatively, the midsole lower portion may extend around a perimeter of the top surface of the midsole upper portion from a medial side of the sole structure to a lateral side of the sole structure.

An article of footwear may incorporate the sole structure described above.

In another configuration, a sole structure for an article of footwear includes a midsole, a cushion disposed in the midsole and including an inner portion, and an outsole including a first surface defining a ground-contacting surface and an upper surface disposed on an opposite side of the outsole than the ground-contacting surface and opposing the cushion, the outsole including a protrusion that is aligned with the inner portion and includes arcuate surfaces that terminate at an apex defining an outermost extent of the ground-contacting surface.

The sole structure may include one or more of the following optional features. For example, the cushion may include an outer portion extending around an outer perimeter of the inner portion. The inner portion may be a fluid-filled chamber and the outer portion may be a fluid-filled chamber. In this configuration, the inner portion may have a first pressure and the outer portion may have a second pressure, the first pressure being lower than the second pressure.

In one configuration, the midsole may include a midsole upper portion and a midsole lower portion, the midsole lower portion disposed between the cushion and the upper surface of the outsole and the midsole upper portion disposed on an opposite side of the cushion than the midsole lower portion. The midsole upper portion may be made of a first material and the midsole lower portion may be made of a second material, the first material being softer than the second material. Additionally or alternatively, the midsole upper portion and the midsole lower portion may cooperate to define a pocket that receives the cushion therein. The pocket may include a first portion conforming to at least a portion of the inner portion, a second portion conforming to at least a portion of the outer portion, and a third portion disposed between the first portion and the second portion and being spaced apart from the cushion to define a gap between the cushion and at least one of the midsole upper portion and the midsole lower portion. The pocket may be disposed in a heel region of the sole structure.

The midsole upper portion and the midsole lower portion may be in contact with one another in at least one of a midfoot region of the sole structure and a forefoot region of the sole structure. In this configuration, the midsole lower portion may extend from the upper surface of the outsole to a top surface of the midsole upper portion in the forefoot region of the sole structure. Further, the midsole lower portion may be substantially flush with the top surface of the midsole upper portion in the forefoot region. Additionally or alternatively, the midsole lower portion may extend around a perimeter of the top surface of the midsole upper portion from a medial side of the sole structure to a lateral side of the sole structure.

An article of footwear may incorporate the sole structure described above.

In another configuration, a sole structure for an article of footwear includes a midsole including an upper portion having upper legs and a lower portion having lower legs, the upper legs and the lower legs collectively defining a plurality of side openings, a cushion disposed in the midsole and including a plurality of lobes, the plurality of lobes being exposed within the plurality of side openings between the upper legs and the lower legs of the midsole, and an outsole including a first portion that extends in a direction away from the midsole to a greater extent than any other portion of the outsole.

The sole structure may include one or more of the following optional features. For example, the first portion may be located in a heel region of the sole structure. Additionally or alternatively, the outsole may include a second portion that surrounds the first portion. In this configuration, the second portion may be spaced apart and separated from the first portion. Further, the midsole may be exposed between the first portion of the outsole and the second portion of the outsole. The second portion of the outsole may include a first segment extending along a posterior end of the sole structure, a second segment extending along a medial side of the sole structure, and a third segment extending along a lateral side of the sole structure.

In one configuration, lobes of the plurality of lobes may include an arcuate outer surface. In this configuration, the arcuate outer surface may form an external surface of the sole structure.

At least one lobe of the plurality of lobes may extend past an outer perimeter of the midsole. Additionally or alternatively, the cushion may be a fluid-filled chamber and, further, the fluid-filled chamber may be pressurized.

An article of footwear may incorporate the sole structure described above.

Figure 2:
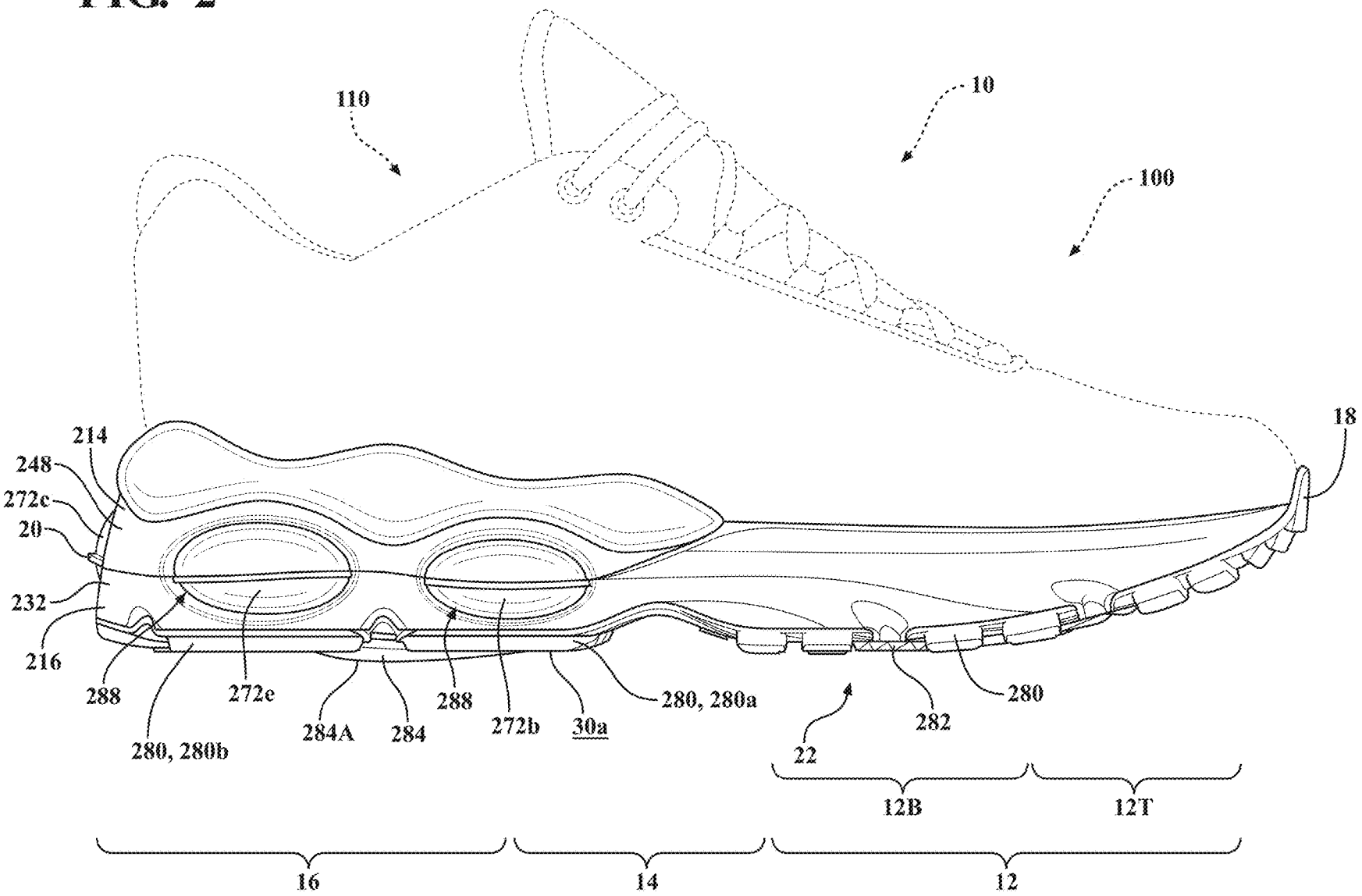
FIG. 2 is a lateral side view of the article of footwear shown in FIG. 1.
Figure 3:
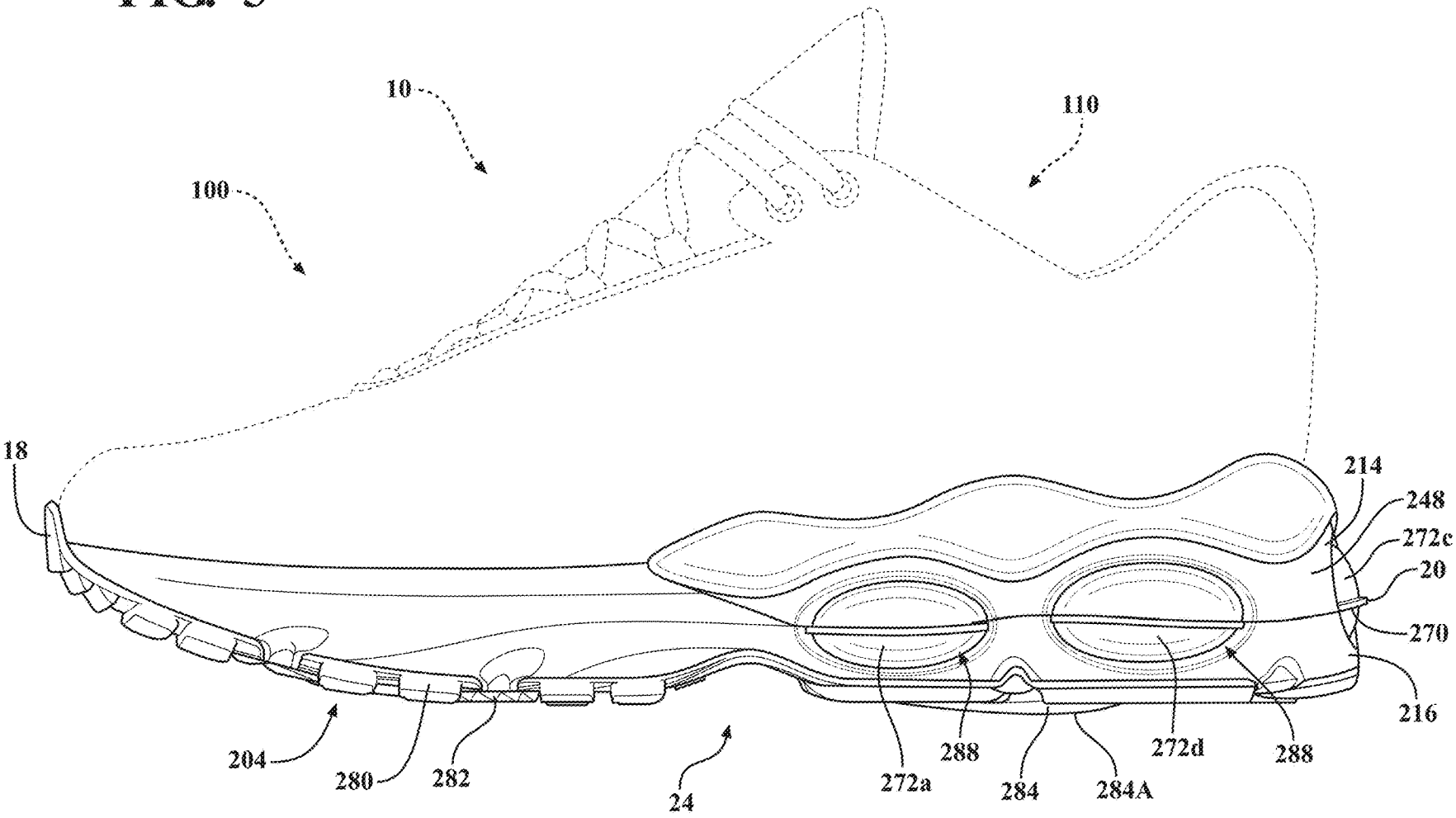
FIG. 3 is a medial side view of the article of footwear shown in FIG. 1.

Referring to FIGS. 1-5, a first aspect of an article of footwear 10 includes an upper 100 and a sole structure 200. The article of footwear 10 may be divided into one or more regions. The regions may include a forefoot region 12, a mid-foot region 14, and a heel region 16, as shown in FIG. 2. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone.

Figure 4:
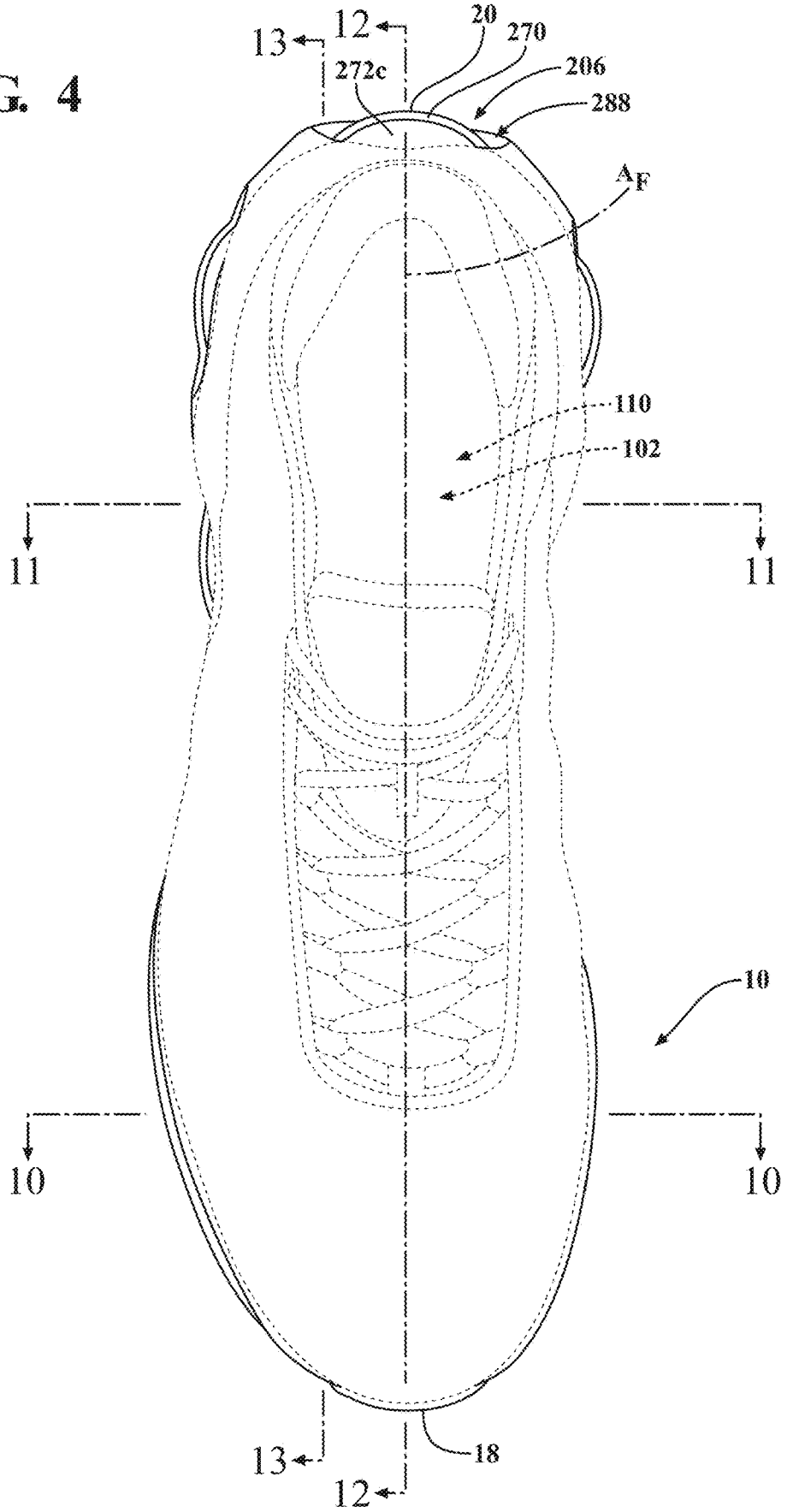
FIG. 4 is a top plan view of the article of footwear shown in FIG. 1.

The footwear 10 may further include an anterior end 18 associated with a forward-most point of the forefoot region 12, and a posterior end 20 corresponding to a rearward-most point of the heel region 16. As shown in FIG. 4, a longitudinal axis of the footwear 10 extends along a length of the footwear 10 from the anterior end 18 to the posterior end 20, parallel to a ground surface. The longitudinal axis is centrally located along the length of the footwear 10, and generally divides the footwear 10 into a lateral side 22 and a medial side 24. Accordingly, the lateral side 22 and the medial side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the lateral side 22 and the medial side 24.

Figure 11:
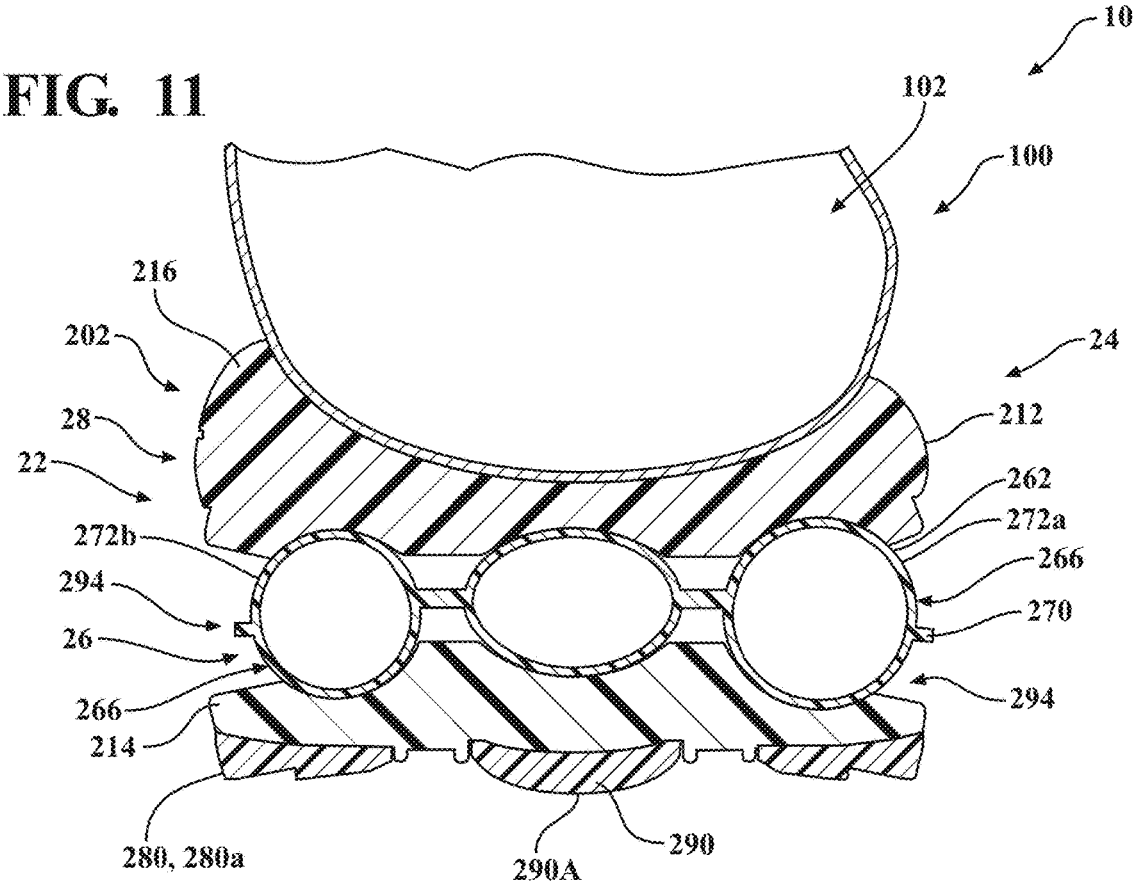
FIG. 11 is a cross-sectional view taken along line 11-11 of FIG. 4.

The article of footwear 10 and, more particularly, the sole structure 200, may be further described as including a peripheral region 26 and an interior region 28, as shown in FIG. 11. The peripheral region 26 is generally described as being a region between the interior region 28 and an outer perimeter of the sole structure 200. Particularly, the peripheral region 26 extends from the forefoot region 12 to the heel region 16 along each of the medial side 24 and the lateral side 22, and wraps around each of the forefoot region 12 and the heel region 16. The interior region 28 is circumscribed by the peripheral region 26, and extends from the forefoot region 12 to the heel region 16 along a central portion of the sole structure 200.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

As best shown in FIGS. 7A and 10-13, the upper 100 may include a strobel 104 having a bottom surface 106 opposing the sole structure 200 and an opposing top surface defining a footbed 108 of the interior void 102. Stitching or adhesives may secure the strobel 104 to the upper 100. A profile of the footbed 108 is defined by the sole structure 200, and may be contoured to conform to a profile of the bottom surface (e.g., plantar) of the foot. Optionally, the upper 100 may also incorporate additional layers such as an insole or sockliner (not shown) that may be disposed upon the strobel 104 and reside within the interior void 102 of the upper 100 to receive a plantar surface of the foot to enhance the comfort of the article of footwear 10.

Referring again to FIG. 1, an ankle opening 110 in the heel region 16 may provide access to the interior void 102. For example, the ankle opening 110 may receive a foot to secure the foot within the void 102 and facilitate entry and removal of the foot from and to the interior void 102. In some examples, one or more fasteners 112 extend along the upper 100 to adjust a fit of the interior void 102 around the foot and to accommodate entry and removal of the foot therefrom. The upper 100 may include apertures 114 such as eyelets and/or other engagement features such as fabric or mesh loops that receive the fasteners 112. The fasteners 112 may include laces, straps, cords, hook-and-loop, or any other suitable type of fastener. The upper 100 may include a tongue portion (not shown) that extends between the interior void 102 and the fasteners 112.

With reference to FIGS. 6A-7B, the sole structure 200 includes a midsole 202 and an outsole 204. Generally, the midsole 202 is configured to impart performance characteristics to the sole structure 200 such as cushioning, responsiveness, and energy distribution. The outsole 204 may be attached to or formed integrally with the midsole 202, and forms a ground-contacting surface 30*a* of the article of footwear 10. Accordingly, the outsole 204 is configured to impart characteristics related to traction and abrasion resistance.

The midsole 202 is formed as a composite structure and includes a cushion or fluid-filled chamber 206. As described in greater detail below, the fluid-filled chamber 206 cooperates with the midsole 202 to provide stability and cushioning to the foot.

The midsole 202 further includes a bottom surface 208 formed on an opposite side of the midsole 202 from a top surface 210. The bottom surface 208 defines a profile of a ground-contacting surface 30*a* of the sole structure 200. A peripheral side surface 212 of the midsole 202 extends between the top surface 210 and the bottom surface 208, and defines an outer peripheral profile of the sole structure 200. It should be appreciated that the peripheral side surface 212 may not necessarily be continuous, but may include openings as described in greater detail below.

The midsole 202 is formed of a resilient polymeric material, such as foam or rubber, to impart properties of cushioning, responsiveness, and energy distribution to the foot of the wearer. Example resilient polymeric materials for the midsole 202 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed below for the barrier layers 262. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The midsole 202 may include a midsole upper portion 214 and a midsole lower portion 216. In one aspect, the midsole upper portion 214 may be formed of a first material 218 and the midsole lower portion 216 may be formed of a second material 220 that is different than the first material 218 to impart a different cushioning response. In one configuration, the first material 218 is softer than the second material 220, meaning that the first material 218 is more easily deformed or compressed by a load relative to the second material 220. It should be appreciated that the resilient polymeric materials described herein may be used to form both portions 214, 216.

The midsole upper portion 214 cooperates with the midsole lower portion 216 to support the fluid-filled chamber 206. The midsole upper portion 214 is configured to be disposed between the upper 100 and the midsole lower portion 216 and the midsole lower portion 216 is configured to be disposed between the midsole upper portion 214 and the outsole 204. The top surface 210 of the midsole 202 is the top surface of the midsole upper portion 214 and the bottom surface of the midsole lower portion 214 is the bottom surface 208 of the midsole 202. The peripheral side surface 212 of the midsole 202 is defined by the peripheral side of the midsole upper portion 214 and the midsole lower portion 216, collectively. The midsole lower portion 216 is longer than the midsole upper portion 214 and is configured to receive the midsole upper portion 214. In so doing, the midsole upper portion 214 and the midsole lower portion 216 cooperate to form a continuous and smooth surface that is flush with the bottom surface 104 of the upper 100, as shown in FIGS. 6A and 10-13.

With reference again to FIG. 6A, the midsole lower portion 216 includes a forefoot pocket 222 formed on an interior surface 224*a* of the midsole lower portion 216. The interior surface 224*a* is located on an opposite side of the midsole lower portion 216 than the bottom surface 208. The forefoot pocket 222 is generally centered within the forefoot region 12 and is bounded by a peripheral lip 226 extending from the medial side 24 to the lateral side 22 and along the forefoot region 12. The peripheral lip 226 has a generally constant width so as to center the forefoot pocket 222 within the forefoot region 12 of the midsole lower portion 216. As shown, the forefoot pocket 222 generally includes a curved portion disposed proximate to the anterior end 18 of the sole structure 200 and sidewalls formed by walls of the peripheral lip 226 that extend in a direction away from the anterior end 18. The curved portion cooperates with the walls to provide the forefoot pocket 222 with a substantially U-shape.

The midsole lower portion 216 further includes a lower pocket 228 disposed within the heel region 16 of the midsole lower portion 216. In one configuration, the lower pocket 228 includes a generally uniform arcuate surface that bounds the heel region 16 of the midsole lower portion 216 and defines the lower pocket 228. A plurality of lower legs 232 project upwardly from the lower pocket 228 and are spaced apart from each other to form lower gaps 234 between each of the lower legs 232. As shown in FIG. 6, the lower gaps 234 have an arcuate bottom surface 234*a*, which provides each lower gap 234 with a substantially U-shape.

A lower chamber support 236 is disposed within the lower pocket 228. In one configuration, the lower chamber support 236 is generally centered within the lower pocket 228 such that the lower pocket 228 is concentric with the lower chamber support 236. As shown in FIG. 6, the arcuate surface of the lower pocket 228 bounds the periphery of the lower chamber support 236 such that the lower pocket 228 surrounds the lower chamber support 236. The lower chamber support 236 is defined by a lower annular ring 240 and is shaped to receive a portion of the fluid-filled chamber 206, as will be described in more detail below.

With reference again to FIGS. 6B and 7A, the midsole upper portion 214 includes an interior surface 224*b* formed on an opposite side of the midsole upper portion 214 than the top surface 210 and opposes the interior surface 224*a* of the midsole lower portion 216. The midsole upper portion 214 includes a forefoot portion 242 that is dimensioned and shaped to be received within the forefoot pocket 222 of the midsole lower portion 216. Once the forefoot portion 242 is received by the forefoot pocket 222, the top surface of the midsole upper portion 214 cooperates with the peripheral lip 226 of the midsole lower portion 216 to form the substantially uniform top surface 210 of the midsole 202. In so doing, the top surface of the midsole upper portion 214 is substantially flush with the top surface of the peripheral lip 226 of the midsole lower portion 216. The uniform top surface formed by the midsole upper portion 214 and the midsole lower portion 216 opposes the bottom surface 106 of the strobel 104 once the midsole 202 is assembled. In one configuration, the peripheral lip 226 of the midsole lower portion 216 extends around a perimeter of the top surface of the forefoot portion 242 of the midsole upper portion 214 from the medial side 24 to the lateral side 22 of the sole structure 200. As such, the midsole lower portion 216 forms a periphery of the midsole 202 in the forefoot region 12 and the midsole upper portion 214 forms a central portion of the midsole 202 in the forefoot region 12.

The midsole upper portion 214 further includes an upper pocket 244 formed on the interior surface 224*b*. The upper pocket 244 is disposed within the heel region 16 of the midsole upper portion 214 and includes a generally uniform, arcuate surface. An upper side wall 246 bounds the heel region of the midsole upper portion 214 and includes a plurality of upper legs 248 that project downwardly from the interior surface 224*b* of the midsole upper portion 214. The upper legs 248 are spaced apart from each other so as to form upper gaps 250 between each of the upper legs 248. The upper gaps 250 have an arcuate top surface 250*a*, which provides each upper gap 250 with a substantially U-shape that opposes the lower gaps 234 of the midsole lower portion 216.

An upper chamber support 252 is disposed within the upper pocket 244. In one configuration, the upper chamber support 252 is generally centered within the upper pocket 244 and is concentric with the upper pocket 244. The arcuate surface of the upper pocket 244 bounds the periphery of the upper chamber support 252. The upper chamber support 252 is defined by an upper annular ring 258 and is shaped to receive a portion of the fluid-filled chamber 206, as will be described in more detail below.

Figure 7A:
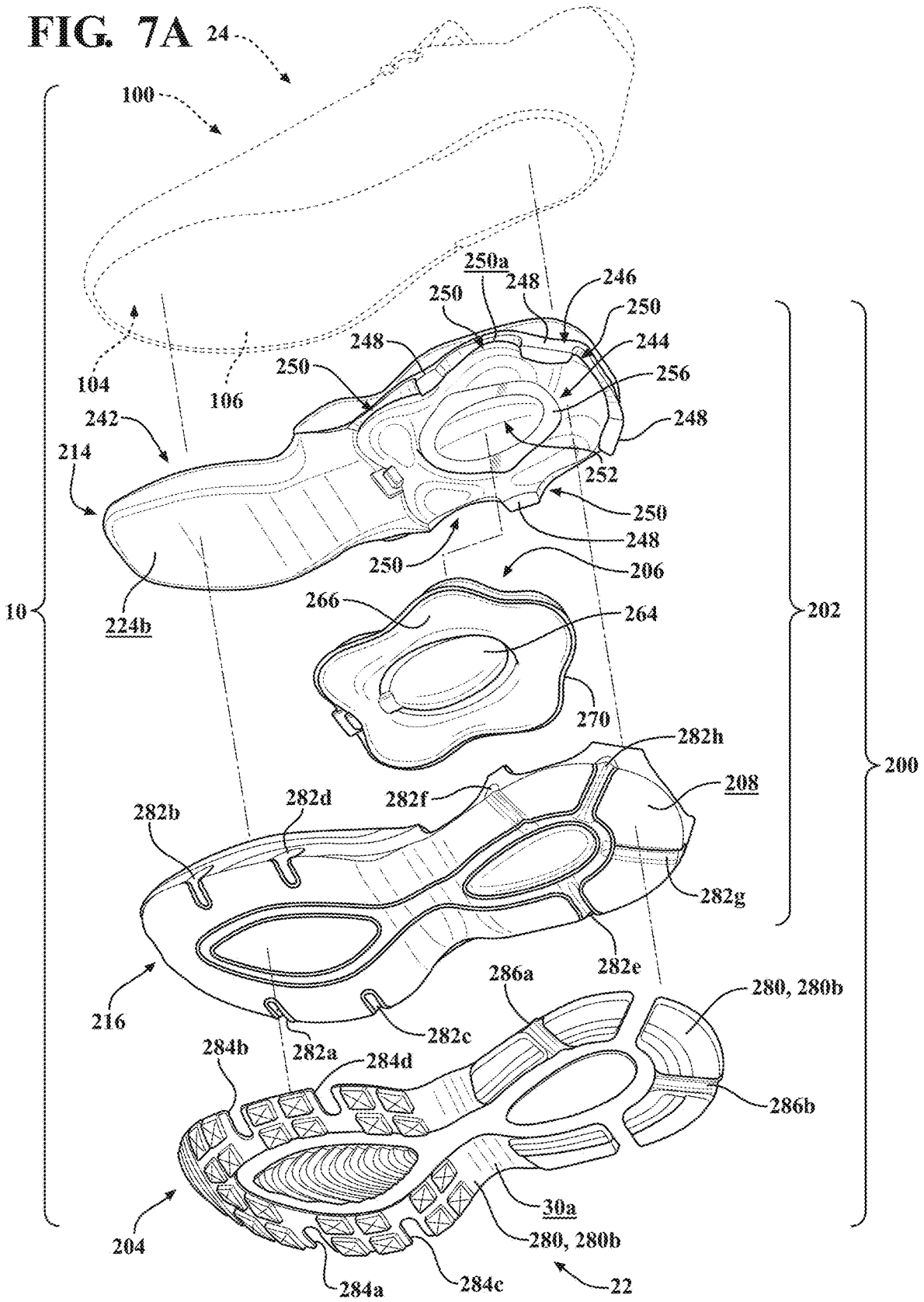
FIG. 7A is an exploded bottom perspective view of the article of footwear of FIG. 1.
Figure 7B:
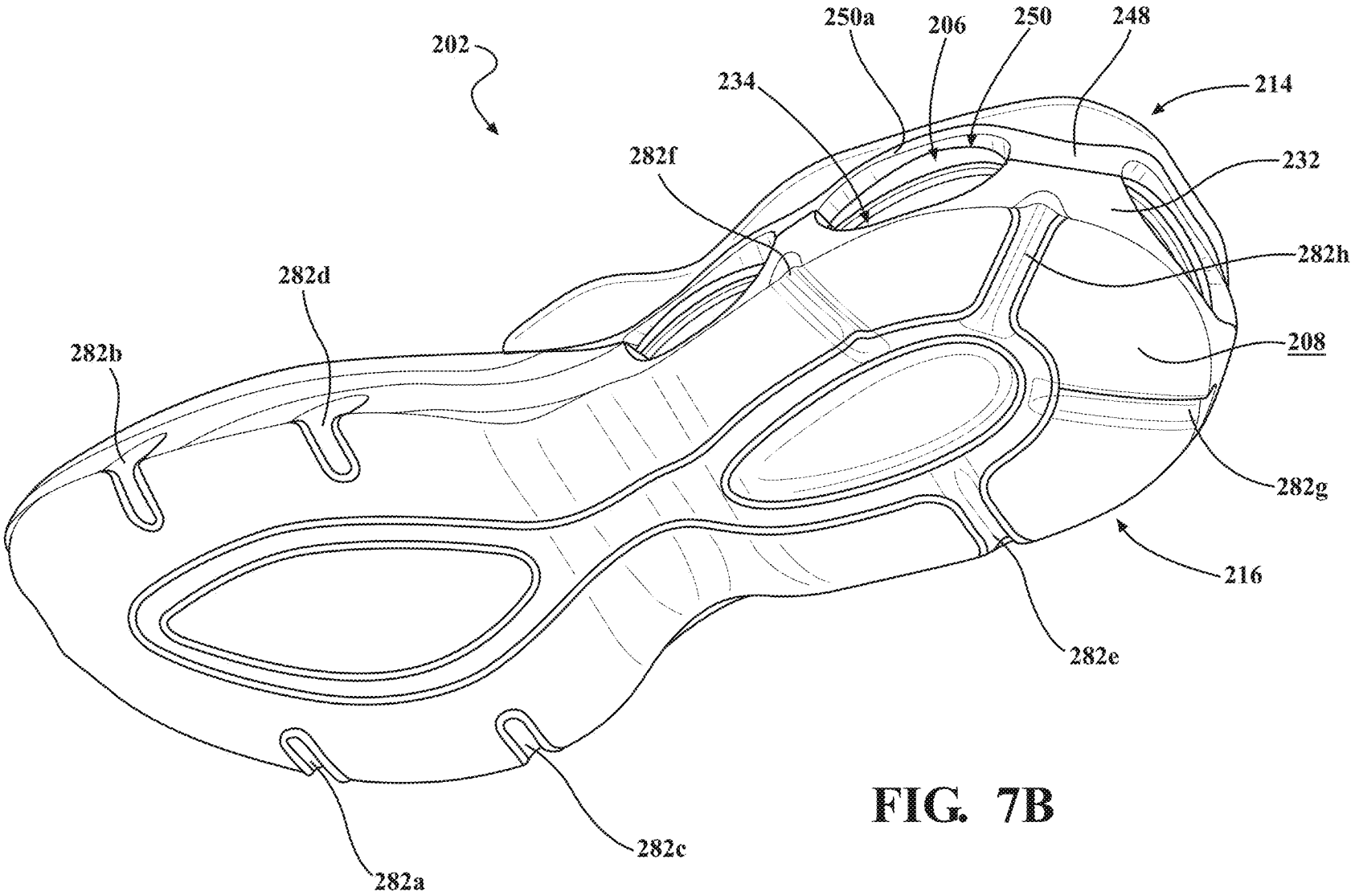
FIG. 7B is a bottom perspective view of the midsole shown in FIG. 7A.
Figure 8B:
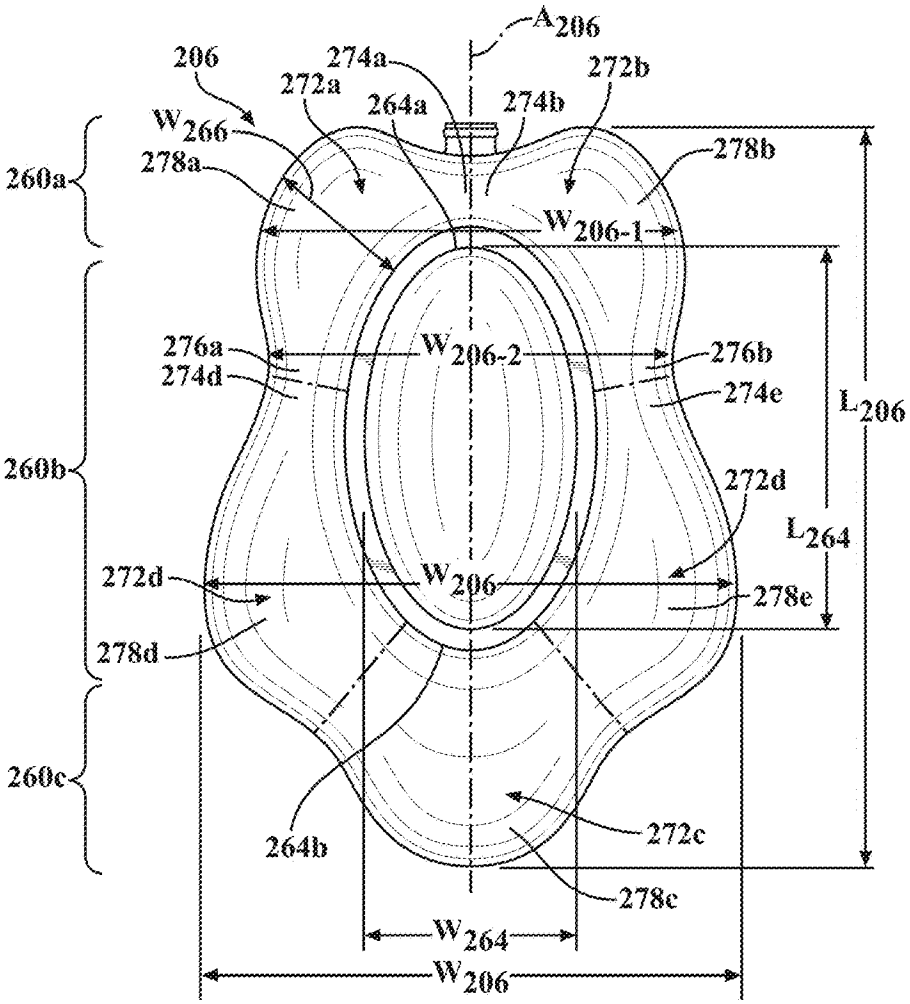
FIGS. 8A and 8B are top plan views of a fluid-filled chamber of a sole structure in accordance with principles of the present disclosure.
Figure 8A:
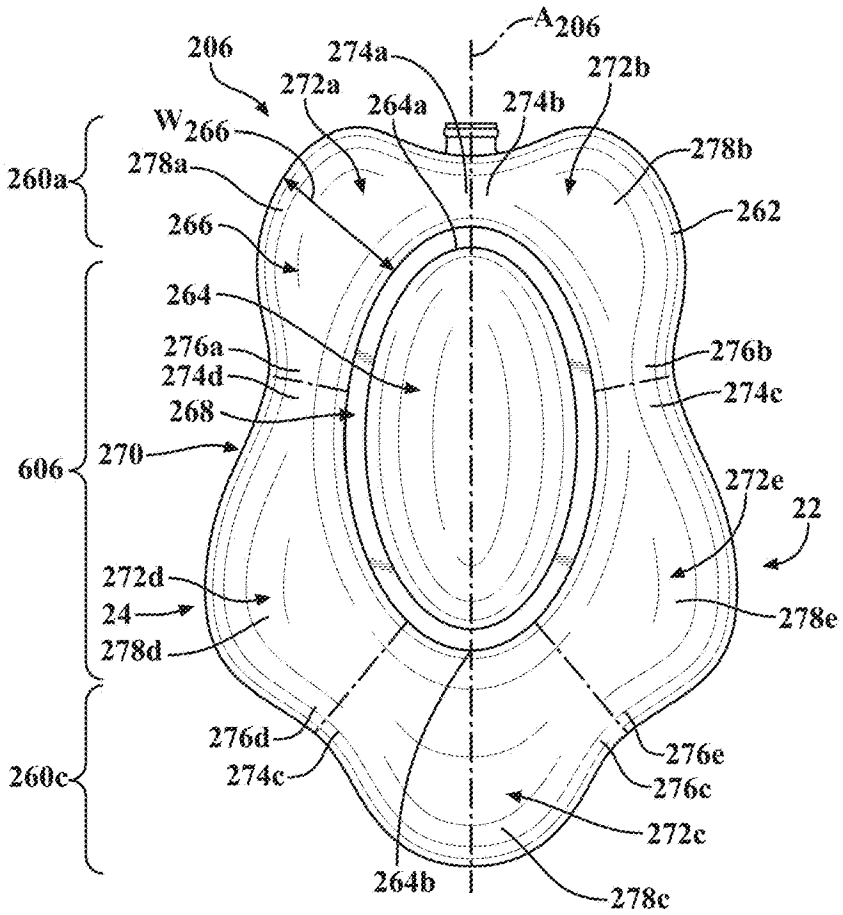
Figure 9:
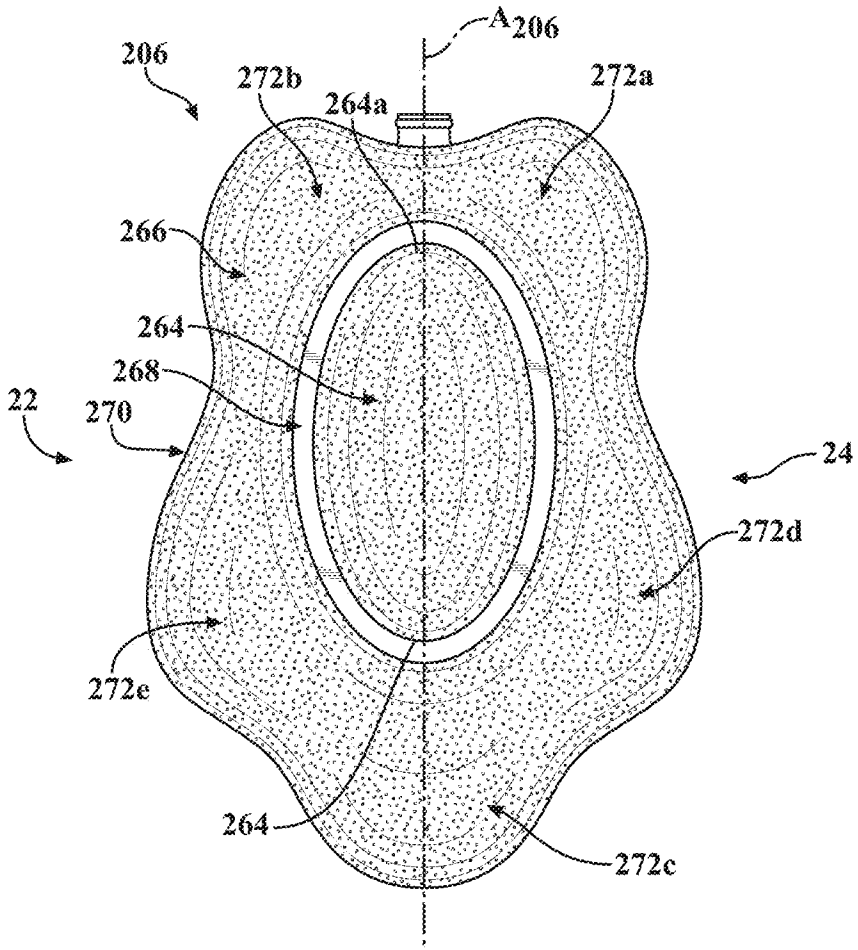
FIG. 9 is a bottom plan view of the fluid-filled chamber of FIGS. 8A and 8B.

With reference to again to FIGS. 6A-7B, and now to FIGS. 8A-9, the fluid-filled chamber 206 of the midsole 202 may be described as extending along a longitudinal axis $A_{206}$ from a first, anterior end 260*a* to a second, posterior end 260*c* disposed at an opposite end of the fluid-filled chamber 206 than the anterior end 260*a*. When incorporated into the article of footwear 10, the anterior end 260*a* of the fluid-filled chamber 206 is disposed within the heel region 16 or the mid-foot region 14 and faces the anterior end 18 of the sole structure 200, while the posterior end 260*c* is disposed at the posterior end 20 of the footwear 10. The fluid-filled chamber 206 may be further described as including an intermediate region 260*b* disposed between the anterior end 260*a* and the posterior end 260*c*. The geometry and features of the fluid-filled chamber 206 may also be described relative to the peripheral region 26 and the interior region 28 of the article of footwear 10.

Figure 12:
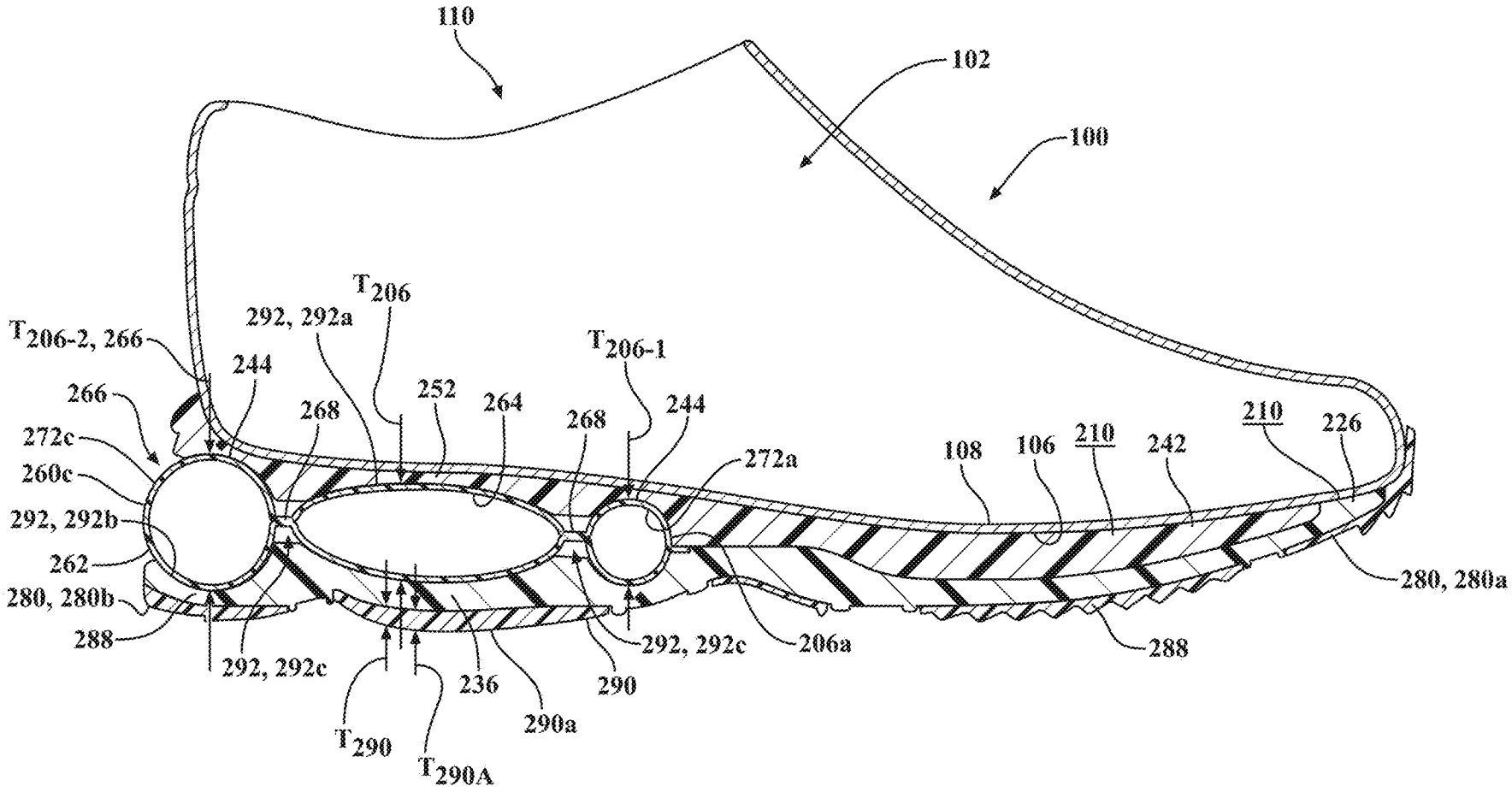
FIG. 12 is a cross-sectional view taken along line 12-12 of FIG. 4.
Figure 13:
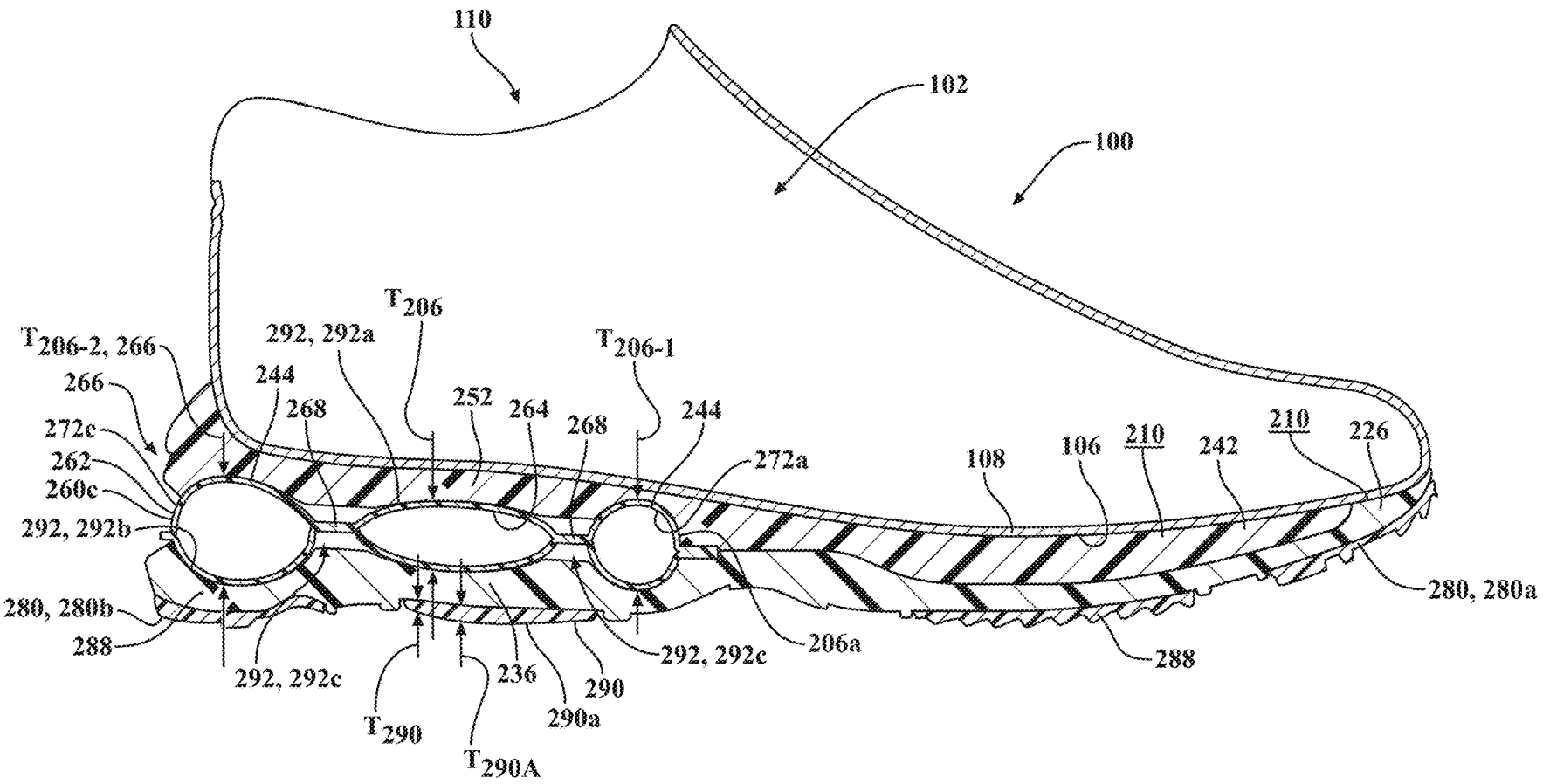
FIG. 13 is a view of FIG. 12 in a compressed state.

As shown in the cross-sectional views of FIGS. 11-13, the fluid-filled chamber 206 may be formed by an opposing pair of barrier layers 262, which can be joined to each other at discrete locations to define an overall shape of the fluid-filled chamber 206. Alternatively, the fluid-filled chamber 206 can be produced from any suitable combination of one or more barrier layers. As used herein, the term "barrier layer" (e.g., barrier layers 262) encompasses both monolayer and multilayer films. In some embodiments, one or both of the barrier layers 262 are each produced (e.g., thermoformed or blow molded) from a monolayer film (a single layer). In other embodiments, one or both of the barrier layers 262 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 262 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 262 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldipheny1-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 262 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 262 include two or more sublayers, examples of suitable multilayer films include microlayer films, such as those disclosed in Bonk et al., U.S. Pat. No. 6,582,786, which is incorporated by reference in its entirety. In further embodiments, the barrier layers 262 may each independently include alternating sublayers of one or more TPU copolymer materials and one or more EVOH copolymer materials, where the total number of sublayers in each of the barrier layers 262 includes at least four (4) sublayers, at least ten (10) sublayers, at least twenty (20) sublayers, at least forty (40) sublayers, and/or at least sixty (60) sublayers.

The fluid-filled chamber 206 can be produced from the barrier layers 262 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 262 can be produced by co-extrusion followed by vacuum thermoforming to form the profile of the fluid-filled chamber 206, which can optionally include one or more valves (e.g., one way valves) that allows the fluid-filled chamber 206 to be filled with the fluid (e.g., gas).

The fluid-filled chamber 206 desirably has a low gas transmission rate to preserve its retained gas pressure. In some embodiments, the fluid-filled chamber 206 has a gas transmission rate for nitrogen gas that is at least about ten (10) times lower than a nitrogen gas transmission rate for a butyl rubber layer of substantially the same dimensions. In an aspect, fluid-filled chamber 206 has a nitrogen gas transmission rate of 15 cubic-centimeter/square-meteratmosphereday ($cm^3/m^2 \cdot atm \cdot day$) or less for an average film thickness of 500 micrometers (based on thicknesses of barrier layers 262). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the illustrated example, the interior surfaces of the barrier layers 262 are joined together at discrete locations to define a plurality of chambers 264, 266. As shown in FIGS. 11-13, the upper and lower barrier layers 262 are spaced apart from each other to define respective interior voids of each of the chambers 264, 266, while the barrier layers 262 are joined or attached to each other to form a web area 268 and a peripheral seam 270 surrounding each of the chambers 264, 266.

With reference again to FIGS. 8A-9, the fluid-filled chamber 206 includes a first, inner chamber 264 disposed in the interior region 28 of the fluid-filled chamber 206 and a second, outer chamber 266 extending around an outer perimeter of the inner chamber 264 to surround the inner chamber 264. The web area 268 surrounds the inner chamber 264 and separates the inner chamber 264 from the outer chamber 266 such that the interior voids of the inner chamber 264 and the outer chamber 266 are fluidly isolated from each other (i.e., fluid or media cannot transfer between the interior voids). The peripheral seam 270 extends around the outer periphery of the outer chamber 266 and defines an outer peripheral profile of the fluid-filled chamber 206.

As shown in FIGS. 8A-9, the inner chamber 264 extends continuously along the longitudinal axis $A_{206}$ of the fluid-filled chamber 206. When incorporated within the article of footwear 10, the inner chamber 264 is configured to support a central portion of the heel corresponding to the bottom of the calcaneus bone, while the outer chamber 266 provides a separate support structure that receives a portion of the heel therein.

In the illustrated example, the inner chamber 264 is formed as an ovoid, whereby the upper barrier layer 262 and the lower barrier layer 262 are both convex in shape such that a cross section of the inner chamber 264 tapers along the length $L_{206}$ of the fluid-filled chamber 206. However, in other examples, either or both of the barrier layers 262 may have other geometries, and at least a portion of the inner chamber 264 may have a constant cross-sectional area.

With continued reference to FIGS. 8A-9, the outer chamber 266 extends along the peripheral region 26 from the anterior end 260*a* to the posterior end 260*c* of the fluid-filled chamber 206. As shown, the outer chamber 266 completely surrounds the inner chamber 264 such that the interior void of the outer chamber 266 is interminable. As shown, an overall length $L_{206}$ and width $W_{206}$ of the fluid-filled chamber 206 are defined by the outer chamber 266 and, more particularly, by the peripheral seam 270.

Figure 10:
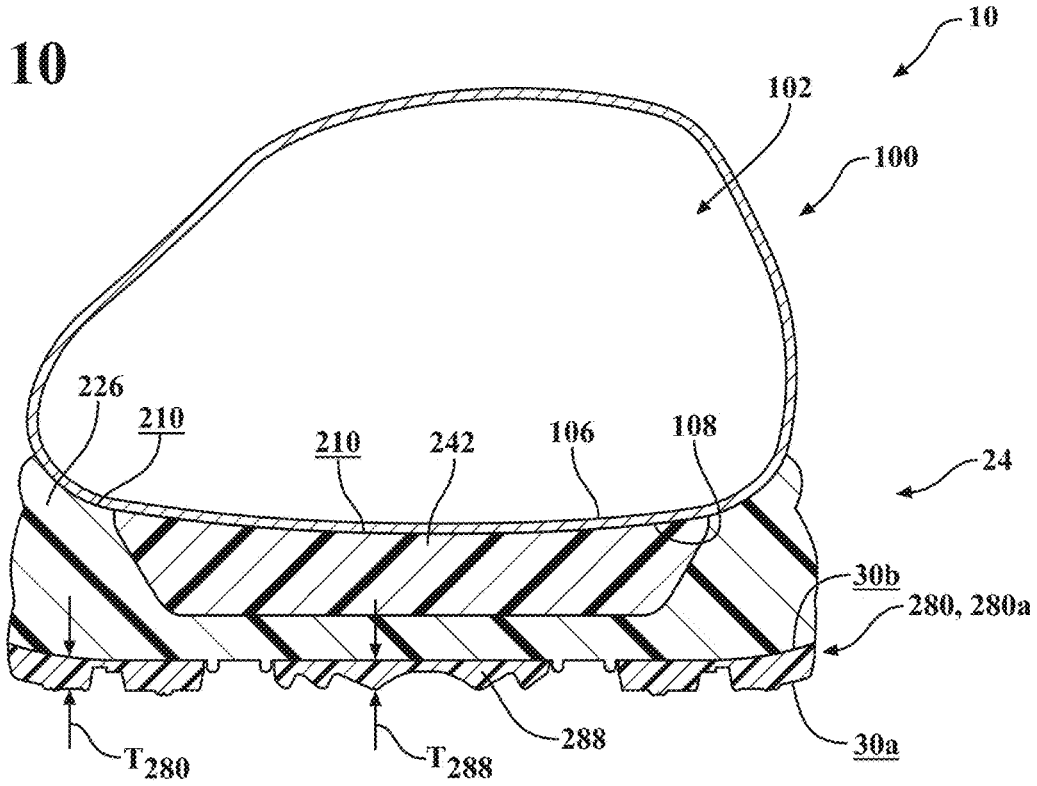
FIG. 10 is a cross-sectional view taken along line 10-10 of FIG. 4.

Referring now to FIGS. 8B and 10, the outer chamber 266 has a length defining the length $L_{206}$ of the fluid-filled chamber 206 whereas the inner chamber 264 has a length $L_{264}$ that is shorter than the length $L_{206}$ of the fluid-filled chamber 206. The outer chamber 266 is formed with a variable cross-section, such that at least one of a width $W_{266}$ and a thickness $T_{266}$ (FIG. 12) of the outer chamber 266 changes along a length of the outer chamber 266. Here, the width $W_{266}$ (FIG. 11B) of the outer chamber 266 is defined as a distance across the outer chamber 266 from the web area 268 to the peripheral seam 270, while the thickness $T_{266}$ (FIG. 12) is defined by the distances across the barrier layers 262 of the fluid-filled chamber 206.

Referring to FIGS. 8A and 8B, the outer chamber 266 may include a plurality of lobes 272*a*-272*e* each forming a portion of the outer chamber 266 having a variable cross-sectional area. For example, each of the lobes 272*a*-272*e* includes a first end 274*a*-274*e* having a first cross-sectional area, a second end 276*a*-276*e* having a second cross-sectional area, and an intermediate portion 278*a*-278*e* disposed between the first end 274*a*-274*e* and the second end 276*a*-276*e* and having a third cross-sectional area that is greater than the first cross-sectional area and the second cross-sectional area. Accordingly, each of the lobes 272*a*-272*e* tapers towards the respective first end 274*a*-274*e* and second end 276*a*-276*e* from the intermediate portion 278*a*-278*e*. In some examples, both the width $W_{266}$ and the thickness $T_{266}$ of each of the lobes 272*a*-272*e* tapers from the intermediate portion 278*a*-278*e*.

The illustrated example of the fluid-filled chamber 206 includes a plurality of the lobes 272*a*-272*e* arranged end-to-end in series around the inner chamber 264, such that the cross-sectional area of the outer chamber 266 alternates between larger and smaller sizes. As shown, the plurality of the lobes 272*a*-272*e* includes a first pair of anterior lobes 272*a*, 272*b* disposed at the anterior end 260*a* of the fluid-filled chamber 206, a posterior lobe 272*c* disposed at the posterior end 260*c* of the fluid-filled chamber 206, and a pair of intermediate lobes 272*d*, 272*e* disposed in the intermediate region 260*b* of the fluid-filled chamber 206.

The anterior lobes 272*a*, 272*b* of the outer chamber 266 include a lateral anterior lobe 272*b* disposed at the anterior end 260*a* on the lateral side 22 of the fluid-filled chamber 206, and a medial anterior lobe 272*a* disposed at the anterior end 260*a* on the medial side 24 of the fluid-filled chamber 206. As shown, the first ends 274*a*, 274*b* of the anterior lobes 272*a*, 272*b* are connected to each other at the longitudinal axis $A_{206}$ of the fluid-filled chamber 206. Each of the anterior lobes 272*a*, 272*b* extends from its respective first end 274*a*, 274*b* and around an anterior end 264*a* of the inner chamber 264 to its respective second end 276*a*, 276*b* in the intermediate region 260*b* of the fluid-filled chamber 206. In the illustrated example, the anterior lobes 272*a*, 272*b* provide the outer chamber 266 with an increased width $W_{266}$ at the lateral and medial sides of the anterior end 260*a* such that the anterior lobes 272*a*, 272*b* form a pair of forward-protruding portions at opposite sides of the anterior end 260*a* of the fluid-filled chamber 206.

With continued reference to FIGS. 8A-9, the posterior lobe 272*c* is disposed at the posterior end 260*c* of the fluid-filled chamber 206 and the intermediate portion 278*c* of the posterior lobe 272*c* is centrally positioned along the longitudinal axis $A_{206}$ of the fluid-filled chamber 206. In the illustrated example, the posterior lobe 272*c* extends around the posterior end 264*b* of the inner chamber 264 from a first end 274*a* on the lateral side 22 of the fluid-filled chamber 206 to a second end 276*c* on the medial side 24 of the fluid-filled chamber 206. As discussed above, the intermediate portion 278*c* has a greater cross-sectional area than each of the ends 274*c*, 276*c*.

The intermediate lobes 272*d*, 272*e* of the outer chamber 266 include a lateral intermediate lobe 272*e* disposed in the intermediate region 260*b* on the lateral side 22 of the fluid-filled chamber 206, and a medial intermediate lobe 272*d* disposed in the intermediate region 260*b* on the medial side 24 of the fluid-filled chamber 206. As shown, first ends 274*d*, 274*e* of the intermediate lobes 272*d*, 272*e* are connected to the second ends 276*a*, 276*b* of the lateral and medial anterior lobes 272*b*, 272*a*, respectively. The second end 276*d* of the lateral intermediate lobe 272*d* is connected to the first end 274*c* of the posterior lobe 272*c* at the posterior end 260*c* of the fluid-filled chamber 206. Likewise, the second end 276*e* of the medial intermediate lobe 272*e* is connected to the second end 276*c* of the posterior lobe 272*c* at the posterior end 260*c* of the fluid-filled chamber 206. Similar to the anterior lobes 272*a*, 272*b* at the anterior end 260*a* and the posterior lobe 272*c* at the posterior end 260*c*, the intermediate lobes 272*d*, 272*e* provide the outer chamber 266 with protruding portions along the lateral and medial sides 22, 24 of the intermediate region 260*b* of the fluid-filled chamber 206.

As shown in FIG. 8B, the variable cross section of the outer chamber 266 results in the overall width $W_{206}$ of the fluid-filled chamber 206 being variable from the anterior end 260*a* to the posterior end 260*c*. Particularly, the fluid-filled chamber 206 has a first width $W_{206\text{-}1}$ across the intermediate portions 278*a*, 278*b* of the anterior lobes 272*a*, 272*b* adjacent to the anterior end 260*a*, a second width $W_{206\text{-}2}$ across the second ends 276*a*, 276*b* of the anterior lobes 272*a*, 272*b* in the intermediate region 260*b*, and a third width $W_{206\text{-}3}$ across the intermediate portions 278*d*, 278*e* of the intermediate lobes 272*d*, 272*e* adjacent to the posterior end 260*c*. Here, the second width $W_{206\text{-}2}$ is less than the first width $W_{206\text{-}1}$ and the third width $W_{206\text{-}3}$, while the third width $W_{206\text{-}3}$ is greater than the first width $W_{206\text{-}1}$ and the second width $W_{206\text{-}2}$.

Referring now to FIG. 10, the thickness $T_{206}$ the fluid-filled chamber 206 generally increases along a direction from the anterior end 260*a* to the posterior end 260*c*. However, as discussed above, because the outer chamber 266 is formed with a variable cross section, the change in thickness $T_{206}$ is not constant and continuous along the length of the fluid-filled chamber 206. Instead, the thickness of the fluid-filled chamber 206 incrementally increases along the length $L_{206}$ of the fluid-filled chamber 206. For example, the fluid-filled chamber 206 has a first thickness $T_{206-1}$ at the anterior end 260*a* defined by the intermediate portions 278*a*, 278*b* of the anterior lobes 272*a*, 272*b* and a second thickness $T_{206-2}$ at the posterior end 260*c* defined by the intermediate portion 278*c* of the posterior lobe 272*c*. Here, the second thickness $T_{206-2}$ is greater than the first thickness $T_{206-1}$ such that an average thickness of the fluid-filled chamber 206 increases from the anterior end 260*a* to the posterior end 260*c*. Furthermore, as shown in the cross-sectional view of FIG. 12, the thickness of the fluid-filled chamber 206 also incrementally increases along the longitudinal axis $A_{206}$. Accordingly, the fluid-filled chamber 206 has a thickness $T_{206}$ at the first ends 274*a*, 274*b* of the anterior lobes 272*a*, 272*b* that is less than the thickness $T_{206}$ at the inner chamber 264, which is, in turn, less than the thickness $T_{206}$ at the posterior lobe 272*c*.

The chambers 264, 266 can be provided in a fluid-filled (e.g., as provided in footwear 10) or in an unfilled state. The chambers 264, 266 can be filled to include any suitable fluid, such as a gas or liquid. In an aspect, the gas can include air, nitrogen ($N_2$), or any other suitable gas. The fluid provided to the chambers 264, 266 can result in the fluid-filled chamber 206 being pressurized. Alternatively, the fluid provided to the chambers 264, 266 can be at atmospheric pressure such that the chambers 264, 266 are not pressurized but, rather, simply contain a volume of fluid at atmospheric pressure. In other aspects, the chambers 264, 266 can alternatively include other compressible media, such as pellets, beads, ground recycled material, and the like (e.g., foamed beads and/or rubber beads).

In the illustrated example, the interior void of the inner chamber 264 includes a first fluid at a first pressure and the interior void of the outer chamber 266 includes a second fluid at a second pressure. As discussed above, the inner chamber 264 is isolated from the outer chamber 266 such that the first pressure and the second pressure may be independently maintained within the interior voids. The first pressure and the second pressure may be different from each other. For instance, the first pressure within the interior void of the inner chamber 264 may be less than the second pressure within the interior void of the outer chamber 266 when the fluid-filled chamber 206 is in an uncompressed (i.e., natural) state. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

Providing the fluid-filled chamber 206 with an inner chamber 264 having a lower pressure than the surrounding outer chamber 266 allows the inner chamber 264 to provide a softer cushioning response to a point load applied by the central portion of the heel when sole structure 100 contacts a ground surface. Upon initial compression of the inner chamber 264, the higher pressure of the outer chamber 266 provides secondary cushioning around a perimeter of the heel. Furthermore, the higher pressure of the outer chamber 266 provides the heel region with enhanced lateral (i.e., side-to-side, front-to-back) stability. Thus, the dual-chamber configuration of the fluid-filled chamber 206 advantageously provides both impact attenuation and stability.

Figure 5:
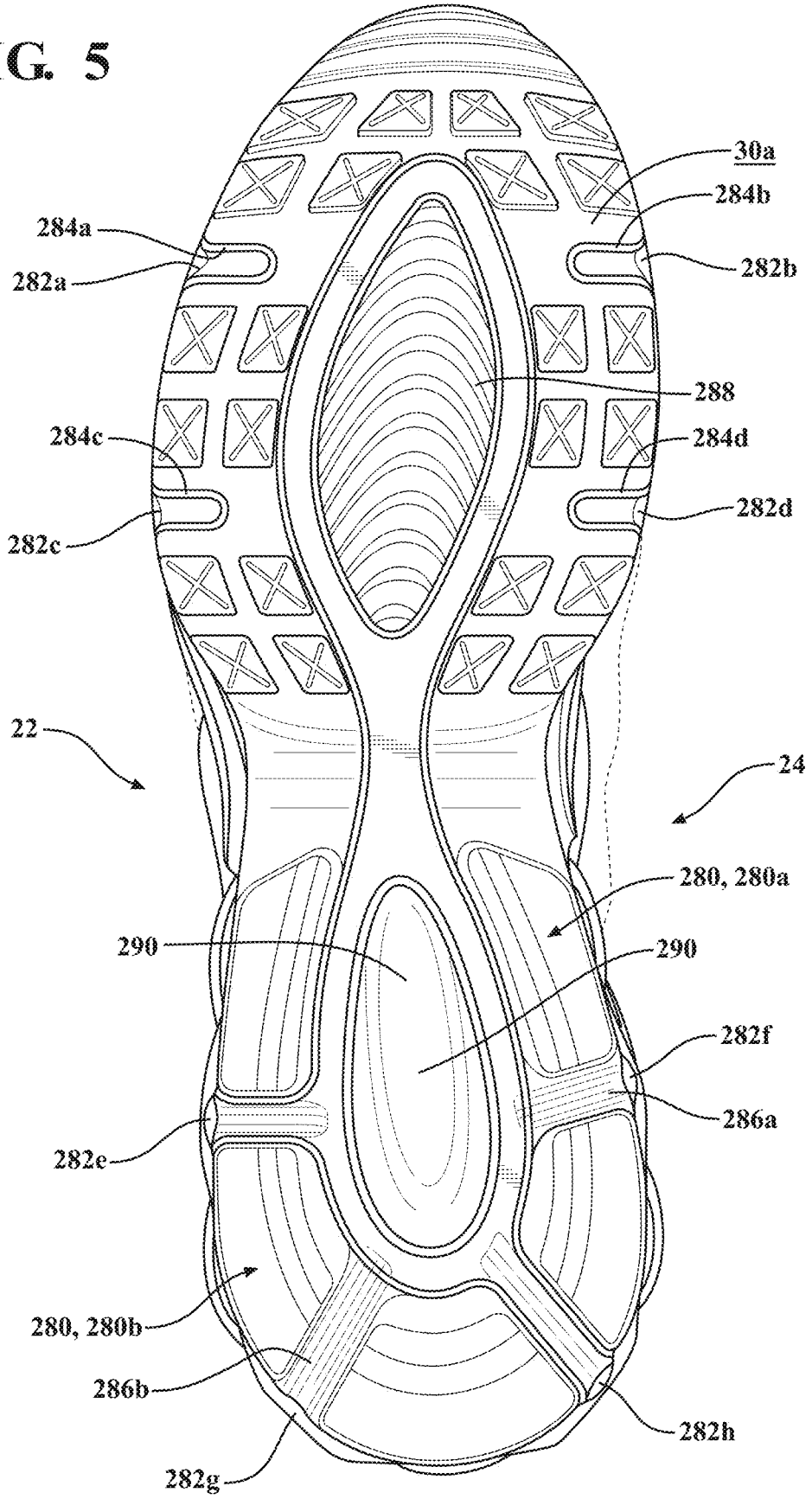
FIG. 5 is a bottom plan view of the article of footwear shown in FIG. 1.
Figure 6A:
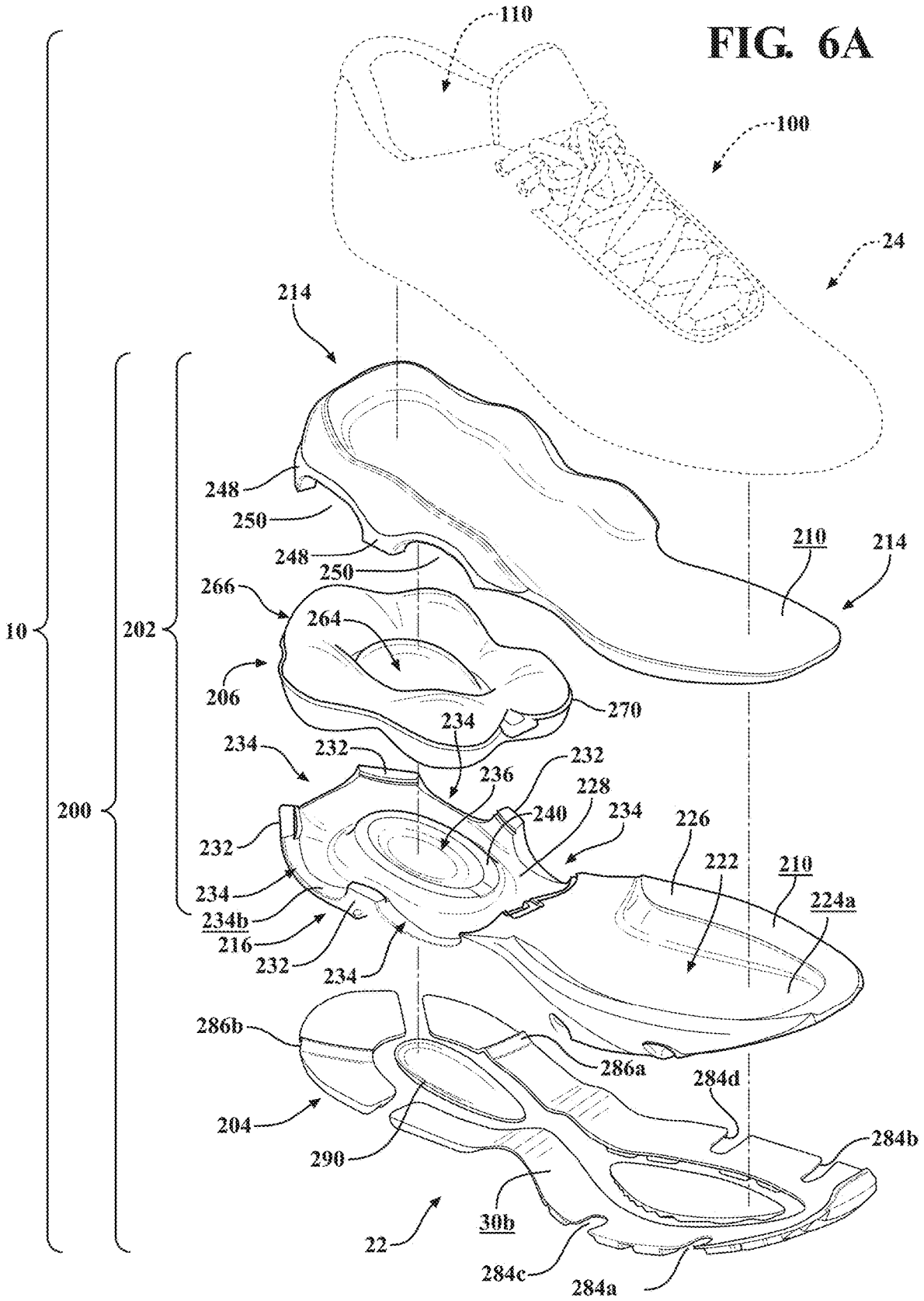
FIG. 6A is an exploded top perspective view of the article of footwear of FIG. 1.
Figure 6B:
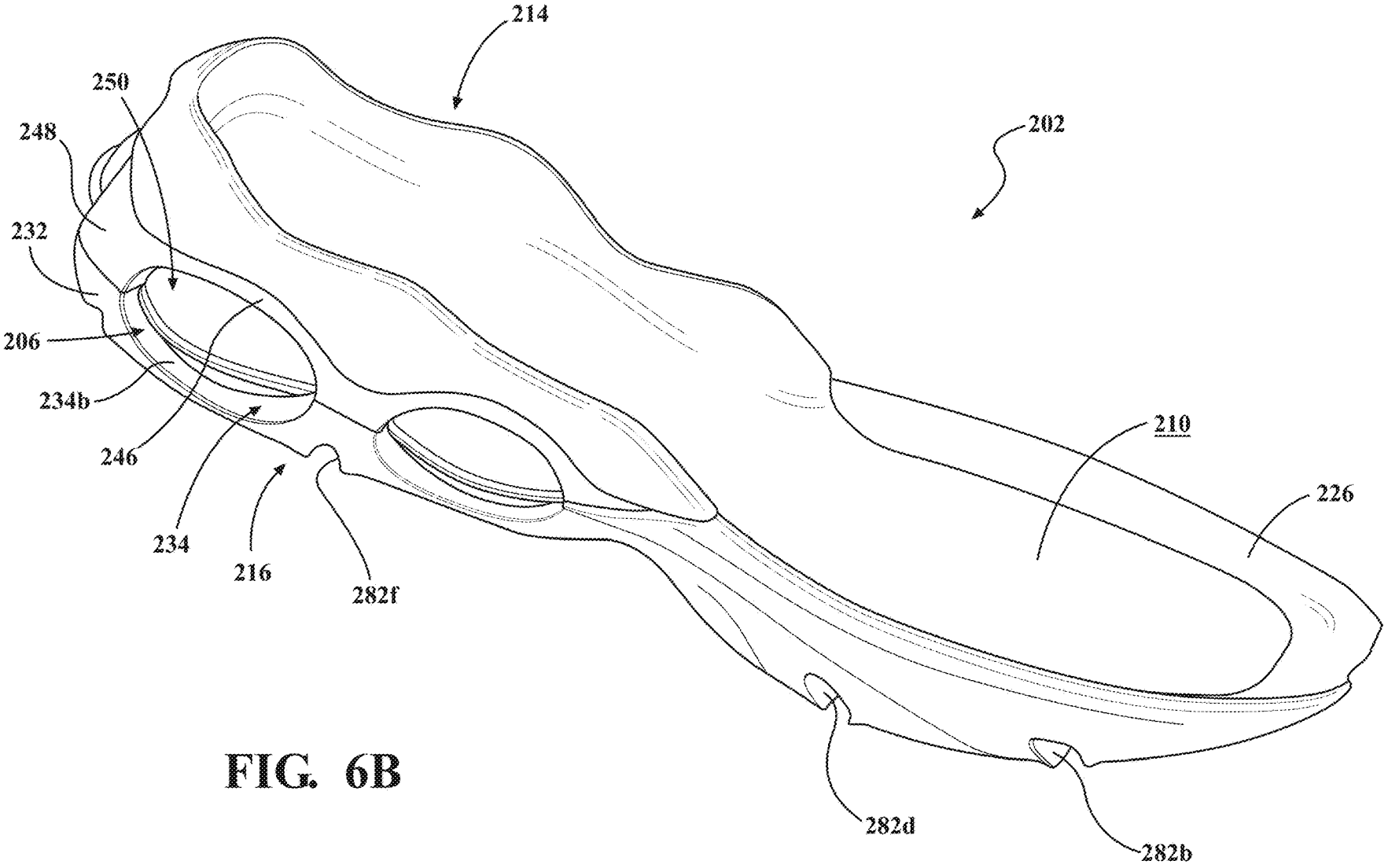
FIG. 6B is a top perspective view of the midsole shown in FIG. 6A.

With reference to FIGS. 5, 6A and 7A, the outsole 204 includes an upper surface 30*b* formed on an opposite side of the outsole 204 than the ground-contacting surface 30*a*. The upper surface 30*b* is opposes and is attached to the bottom surface 208 of the midsole 202.

The outsole 204 includes a peripheral band portion 280 that bounds the periphery of the bottom surface 208 of the midsole 202. The peripheral band portion 280 has a generally constant thickness $T_{280}$ (FIG. 10) and may include a first band portion 280*a* spaced apart from a second band portion 280*b*. As shown in FIGS. 7A and 7B, the bottom surface 208 of the midsole 202 may include a plurality of indents 282*a*-282*h* disposed on the peripheral side surface 212 and extending from a respective lateral and medial side 22, 24 of the midsole 202 towards the center of the midsole 202. The indents 282*a*-282*h* facilitate a flexing of the article of footwear 10 about the heel and the metatarsals of the foot. In particular, the indents 282*a*-282*d* are disposed in the forefoot region 12 and the indents 282*e*-282*h* are disposed in the heel region 16.

The peripheral band portion 280 includes a first portion 280*a* and a second portion 280*b*. The first portion 280*a* has a shape that is commensurate with a periphery of the bottom surface 208 of the midsole 202. The second portion 280*b* is a generally arcuate member shaped to align with a periphery of the heel region 16. The first portion 280*a* is attached to the forefoot region 12 and the midfoot region 14 of the midsole 202 and the second portion 280*b* is attached to the heel region 16. The second portion 280*b* is spaced apart from the first portion 280*a* by the indents 282*f* and 282*g*. The peripheral band portion 280 includes slots 284*a*-284*d* that are aligned with a respective indent 282*a*-282*d*. The slots 284*a*-284*d* are dimensioned to be aligned with the periphery of a respective indent 282*a*-282*d* to facilitate flexing about a respective indent 282*a*-282*d*. The peripheral band portion 280 may further include grooves 286*a*, 286*b* that have a shape conforming to the shape of the respective indents 282*f*, 282*g*.

The outsole 204 further includes a forefoot member 288 and a heel member 290. The forefoot member 288 has a generally oval shape, is dimensioned to be disposed within the space defined by the first portion 280*a* of the peripheral band 280, and is generally centered within the forefoot region 12. Likewise, the heel member 290 is centered within the space defined by the posterior end of the first portion 280*a* and the second portion 280*b*. The heel member 290 is generally oval and is aligned with the inner chamber 264 of the fluid-filled chamber 206. In particular, the heel member 290 is disposed underneath and opposes the inner chamber 264 of the fluid-filled chamber 206. As shown in FIG. 10, a thickness $T_{288}$ of the forefoot member 288 is substantially the same as a thickness $T_{280}$ of the peripheral band 280.

As shown in FIG. 7, the peripheral band 280, the forefoot member 288, and the heel member 290 may be spaced apart and separated from one another. Separating the peripheral band 280 from the forefoot member 288 and/or the heel member 290 provides the sole structure 200 with greater flexibility. Namely, if these components 280, 288, 290 were connected to one another, movement of the lower midsole member 216 would be constrained.

With reference now to FIGS. 2, 3, and 11-13, the ground-contacting surface 30*a* of the heel member 280 is arcuate, as viewed along a height of the heel member 280, wherein a thickness $T_{290}$ of the heel member 290 varies to define a protrusion 290A. The protrusion is generally bulbous and narrows from an apex 290B to the edge of the heel member 290. The thickness $T_{290B}$ at the center of the heel member 290 is configured in such a manner that the heel member 290 defines a protrusion that extends in a direction away from the midsole 202 to a greater extent than any other portion of the outsole 204. In one aspect, the heel member 290 at its greatest thickness $T_{290B}$, defined by the apex 290B of the heel member 290, extends approximately at least 3.00 millimeters beyond the ground-contacting surface 30*a* of the peripheral band 280.

With reference again to FIGS. 1-3, 6B, 7B and 10-13, the midsole upper portion 214 is joined with the midsole lower portion 216 in a manner where the upper legs 248 of the midsole upper portion 214 are joined to a corresponding lower leg 232 of the midsole lower portion 216. When the upper legs 248 and joined to the lower legs 232, the upper annular ring 258 is aligned with the lower annular ring 240, the upper pocket 244 is aligned with the lower pocket 228, and the upper chamber support 252 is aligned with the lower chamber support 236 to define a central pocket 292.

With reference now to FIG. 12, the central pocket 292 includes a first portion 292*a*, defined by the upper chamber support 252 and the lower chamber support 236, collectively. The first portion 292*a* is configured to receive the inner chamber 264 and conforms to an outer surface of the inner chamber 264. In so doing, the inner chamber 264 is pressed against the upper midsole portion 214 and the lower midsole portion 216, as shown in FIG. 11. The central pocket 292 may further include a second portion 292*b* and a third portion 292*c*. The second portion 292*b* is defined by the upper pocket 244 and the lower pocket 228 and receives the outer chamber 266. The second portion 292*b* conforms to the outer chamber 266. In so doing, the outer chamber 266 is pressed against the upper midsole portion 214 and the lower midsole portion 216, as shown in FIG. 11. The third portion 292*c* is defined by the gap between the upper annular ring 258 and the lower annular ring 240 and is disposed between the first portion 292*a* and the second portion 292*b*. The web area 268 is disposed within the gap of the third portion 292*c*.

When the midsole upper portion 214 is joined to the midsole lower portion 216, the midsole lower portion 216 extends from the second surface 30*b* of the outsole 204 to a top surface 210 of the midsole upper portion 214 in the forefoot region 12 of the sole structure 200. The top surface 210 of forefoot portion 242 of the midsole lower portion 214 is flush with the top surface 210 of the peripheral lip 226, as described above. Together, the top surfaces of the midsole upper portion 214 and the peripheral lip 226 are flush with the bottom surface 106 of the strobel 104 to provide a uniform underfoot surface.

The upper gaps 250 are aligned with a corresponding lower gap 235 to define a plurality of side openings 294 bounding the periphery of the heel region 16. The lobes 272*a*-272*e* are exposed through the side openings 294. As such, the fluid-filled chamber 206 is enclosed by the midsole 202. As the midsole upper portion 214 is made of a material softer than the material of the midsole lower portion 216, the compression forces of the midsole 202 vary in a manner where a reaction force increases as the midsole 202 is compressed. Further, the upper legs 248 and the lower legs 232 help stabilize the compression of the fluid-filled chamber 206 by provide resistance to the splaying of the fluid-filled chamber 206 as a result of an applied load, thereby resulting in a stable feel to the wearer. As the heel member 290 extends beyond the plane of the peripheral band portion 280, the inner chamber 264 is struck before the outer chamber 266. As the inner chamber 264 is pressurized at a lower pressure relative to the outer chamber 266, a pistoning effect is generated.

With reference now to FIGS. 11 and 12, an illustration of the pistoning effect is described. As used herein, the term pistoning refers to a loading of the fluid-filled chamber 206, which transmits a reactionary force. In particular, FIG. 11 shows the fluid-filled chamber 206 prior to a compression force. FIG. 11 shows the apex 290A of the heel member 290 protruding further from the ground-contacting surface 30*a* of the peripheral band portion 280 of the outsole 204. Accordingly, it is the heel member 290 which contacts the ground first, wherein a reaction force is formed by the inner chamber 264 before the outer chamber 266, thereby loading the reaction pressure of the inner chamber 264 to generate a pistoning effect and improve energy return to the wearer.

The following Clauses provide an exemplary configuration for a sole structure and an article of footwear described above.

Clause 1. A sole structure for an article of footwear, the sole structure comprising a midsole, a cushion disposed in the midsole and including an inner portion, and an outsole including a first surface defining a ground-contacting surface and an upper surface disposed on an opposite side of the outsole than the ground-contacting surface and opposing the cushion, the outsole including a protrusion that extends in a direction away from the midsole to a greater extent than any other portion of the outsole and being aligned with the inner portion.

Clause 2. The sole structure of Clause 1, wherein the outsole includes a peripheral band, a forefoot member, and a heel member spaced apart and separated from one another.

Clause 3. The sole structure of Clause 2, wherein the heel member includes the protrusion.

Clause 4. The sole structure of Clause 1, wherein the cushion includes an outer portion extending around an outer perimeter of the inner portion.

Clause 5. The sole structure of Clause 4, wherein the outer portion includes a plurality of lobes.

Clause 6. The sole structure of Clause 5, wherein the lobes are exposed through a plurality of side openings of the midsole.

Clause 7. The sole structure of Clause 6, wherein the inner portion is a fluid-filled chamber and the outer portion is a fluid-filled chamber.

Clause 8. The sole structure of Clause 7, wherein the inner portion has a first pressure and the outer portion has a second pressure, the first pressure being lower than the second pressure.

Clause 9. The sole structure of Clause 6, wherein the midsole includes a midsole upper portion and a midsole lower portion, the midsole lower portion disposed between the cushion and the upper surface of the outsole and the midsole upper portion disposed on an opposite side of the cushion than the midsole lower portion.

Clause 10. The sole structure of Clause 9, wherein the midsole upper portion is made of a first material and the midsole lower portion is made of a second material, the first material being softer than the second material.

Clause 11. The sole structure of Clause 9 or 10, wherein the midsole upper portion and the midsole lower portion cooperate to define a pocket that receives the cushion.

Clause 12. The sole structure of Clause 11, wherein the pocket includes a first portion conforming to at least a portion of the inner portion, a second portion conforming to at least a portion of the outer portion, and a third portion disposed between the first portion and the second portion and being spaced apart from the cushion to define a gap between the cushion and at least one of the midsole upper portion and the midsole lower portion.

Clause 13. The sole structure of Clause 11 or 12, wherein the pocket is disposed in a heel region of the sole structure.

Clause 14. The sole structure of Clause 13, wherein the midsole upper portion and the midsole lower portion are in contact with one another in at least one of a midfoot region of the sole structure and a forefoot region of the sole structure.

Clause 15. The sole structure of Clause 14, wherein the midsole lower portion extends from the upper surface of the outsole to a top surface of the midsole upper portion in the forefoot region of the sole structure.

Clause 16. The sole structure of Clause 15, wherein the midsole lower portion is substantially flush with the top surface of the midsole upper portion in the forefoot region.

Clause 17. The sole structure of Clause 15 or 16, wherein the midsole lower portion extends around a perimeter of the top surface of the midsole upper portion from a medial side of the sole structure to a lateral side of the sole structure.

Clause 18. An article of footwear incorporating the sole structure of any of the preceding clauses.

Clause 19. A sole structure for an article of footwear, the sole structure comprising a midsole, a cushion disposed in the midsole and including an inner portion, and an outsole including a first surface defining a ground-contacting surface and an upper surface disposed on an opposite side of the outsole than the ground-contacting surface and opposing the cushion, the outsole including a protrusion that is aligned with the inner portion and includes arcuate surfaces that terminate at an apex defining an outermost extent of the ground-contacting surface.

Clause 20. The sole structure of Clause 19, wherein the cushion includes an outer portion extending around an outer perimeter of the inner portion.

Clause 21. The sole structure of Clause 20, wherein the inner portion is a fluid-filled chamber and the outer portion is a fluid-filled chamber.

Clause 22. The sole structure of Clause 21, wherein the inner portion has a first pressure and the outer portion has a second pressure, the first pressure being lower than the second pressure.

Clause 23. The sole structure of Clause 20, wherein the midsole includes a midsole upper portion and a midsole lower portion, the midsole lower portion disposed between the cushion and the upper surface of the outsole and the midsole upper portion disposed on an opposite side of the cushion than the midsole lower portion.

Clause 24. The sole structure of Clause 23, wherein the midsole upper portion is made of a first material and the midsole lower portion is made of a second material, the first material being softer than the second material.

Clause 25. The sole structure of Clause 23 or 24, wherein the midsole upper portion and the midsole lower portion cooperate to define a pocket that receives the cushion therein.

Clause 26. The sole structure of Clause 25, wherein the pocket includes a first portion conforming to at least a portion of the inner portion, a second portion conforming to at least a portion of the outer portion, and a third portion disposed between the first portion and the second portion and being spaced apart from the cushion to define a gap between the cushion and at least one of the midsole upper portion and the midsole lower portion.

Clause 27. The sole structure of Clause 25 or 26, wherein the pocket is disposed in a heel region of the sole structure.

Clause 28. The sole structure of Clause 27, wherein the midsole upper portion and the midsole lower portion are in contact with one another in at least one of a midfoot region of the sole structure and a forefoot region of the sole structure.

Clause 29. The sole structure of Clause 28, wherein the midsole lower portion extends from the upper surface of the outsole to a top surface of the midsole upper portion in the forefoot region of the sole structure.

Clause 30. The sole structure of Clause 29, wherein the midsole lower portion is substantially flush with the top surface of the midsole upper portion in the forefoot region.

Clause 31. The sole structure of Clause 29 or 30, wherein the midsole lower portion extends around a perimeter of the top surface of the midsole upper portion from a medial side of the sole structure to a lateral side of the sole structure.

Clause 32. An article of footwear incorporating the sole structure of any of the preceding clauses.

Clause 33. A sole structure for an article of footwear, the sole structure comprising a midsole including an upper portion having upper legs and a lower portion having lower legs, the upper legs and the lower legs collectively defining a plurality of side openings, a cushion disposed in the midsole and including a plurality of lobes, the plurality of lobes being exposed within the plurality of side openings between the upper legs and the lower legs of the midsole, and an outsole including a first portion that extends in a direction away from the midsole to a greater extent than any other portion of the outsole.

Clause 34. The sole structure of Clause 33, wherein the first portion is located in a heel region of the sole structure.

Clause 35. The sole structure of Clause 33 or 34, wherein the outsole includes a second portion that surrounds the first portion.

Clause 36. The sole structure of Clause 35, wherein the second portion is spaced apart and separated from the first portion.

Clause 37. The sole structure of Clause 36, wherein the midsole is exposed between the first portion of the outsole and the second portion of the outsole.

Clause 38. The sole structure of Clause 35, wherein the second portion of the outsole includes a first segment extending along a posterior end of the sole structure, a second segment extending along a medial side of the sole structure, and a third segment extending along a lateral side of the sole structure.

Clause 39. The sole structure of any of Clauses 33-39, wherein lobes of the plurality of lobes include an arcuate outer surface.

Clause 40. The sole structure of Clause 39, wherein the arcuate outer surface forms an external surface of the sole structure.

Clause 41. The sole structure of any of Clauses 33-40, wherein at least one lobe of the plurality of lobes extends past an outer perimeter of the midsole.

Clause 42. The sole structure of any of Clauses 33-41, wherein the cushion is a fluid-filled chamber.

Clause 43. The sole structure of Clause 42, wherein the fluid-filled chamber is pressurized.

Clause 44. An article of footwear incorporating the sole structure of any of Clauses 33-43.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole including a midsole upper portion and a midsole lower portion, the midsole upper portion and the midsole lower portion in contact with one another in at least one of a midfoot region of the sole structure and a forefoot region of the sole structure;

a cushion disposed in the midsole and including an inner portion; and an outsole including a first surface defining a ground-contacting surface and an upper surface disposed on an opposite side of the outsole than the ground-contacting surface and opposing the cushion, the outsole including a protrusion that extends in a direction away from the midsole to a greater extent than any other portion of the outsole and being aligned with the inner portion, the midsole lower portion disposed between the cushion and the upper surface of the outsole and the midsole upper portion disposed on an opposite side of the cushion than the midsole lower portion.

2. The sole structure of claim 1, wherein the outsole includes a peripheral band, a forefoot member, and a heel member spaced apart and separated from one another.

3. The sole structure of claim 2, wherein the heel member includes the protrusion.

4. The sole structure of claim 1, wherein the cushion includes a plurality of lobes.

5. The sole structure of claim 4, wherein lobes of the plurality of lobes are exposed through a plurality of side openings of the midsole.

6. The sole structure of claim 1, wherein the midsole upper portion is made of a first material and the midsole lower portion is made of a second material, the first material being softer than the second material.

7. The sole structure of claim 6, wherein the midsole upper portion and the midsole lower portion cooperate to define a pocket that receives the cushion.

8. The sole structure of claim 6, wherein the midsole lower portion extends from the upper surface of the outsole to a top surface of the midsole upper portion in a forefoot region of the sole structure.

9. An article of footwear incorporating the sole structure of claim 1.

10. A sole structure for an article of footwear, the sole structure comprising:

a midsole including a midsole upper portion and a midsole lower portion, the midsole upper portion and the midsole lower portion in contact with one another in at least one of a midfoot region of the sole structure and a forefoot region of the sole structure;

a cushion disposed in the midsole and including an inner portion; and an outsole including a first surface defining a ground-contacting surface and an upper surface disposed on an opposite side of the outsole than the ground-contacting surface and opposing the cushion, the outsole including a protrusion that is aligned with the inner portion and includes arcuate surfaces that terminate at an apex defining an outermost extent of the ground-contacting surface, the midsole lower portion disposed between the cushion and the upper surface of the outsole and the midsole upper portion disposed on an opposite side of the cushion than the midsole lower portion.

11. The sole structure of claim 10, wherein the cushion includes an outer portion extending around an outer perimeter of the inner portion.

12. The sole structure of claim 11, wherein the inner portion is a fluid-filled chamber and the outer portion is a fluid-filled chamber.

13. The sole structure of claim 12, wherein the inner portion has a first pressure and the outer portion has a second pressure, the first pressure being lower than the second pressure.

14. The sole structure of claim 10, wherein the midsole upper portion is made of a first material and the midsole lower portion is made of a second material, the first material being softer than the second material.

15. The sole structure of claim 10, wherein the midsole upper portion and the midsole lower portion cooperate to define a pocket that receives the cushion therein.

16. The sole structure of claim 10, wherein the midsole lower portion extends from the upper surface of the outsole to a top surface of the midsole upper portion in a forefoot region of the sole structure.

17. An article of footwear incorporating the sole structure of claim 10.

* * * * *